US012774607B2

(12) United States Patent
Bogh et al.

(10) Patent No.: US 12,774,607 B2
(45) Date of Patent: Oct. 27, 2026

(54) DECKING ANCHOR, DECKING SYSTEM UTILIZING THE DECKING ANCHOR, AND METHOD OF INSTALLING THE DECKING ANCHOR

(71) Applicant: VERCO DECKING, INC., Phoenix, AZ (US)

(72) Inventors: Brian Hansen Bogh, Yucaipa, CA (US); Christopher Lawrence Brown, Whittier, CA (US)

(73) Assignee: VERCO DECKING, INC., Phoenix, AZ (US)

( * ) Notice: Subject to any disclaimer, the term of this patent is extended or adjusted under 35 U.S.C. 154(b) by 0 days.

(21) Appl. No.: 18/432,667

(22) Filed: Feb. 5, 2024

(65) Prior Publication Data

US 2024/0175273 A1 May 30, 2024

Related U.S. Application Data

(63) Continuation of application No. 16/867,042, filed on May 5, 2020, now Pat. No. 11,891,818.

(Continued)

(51) Int. Cl.

| | |
|---|---|
| ***E04F 15/02*** | (2006.01) |
| ***E04F 15/06*** | (2006.01) |
| *E04F 15/08* | (2006.01) |

(52) U.S. Cl.

CPC ..... *E04F 15/02044* (2013.01); *E04F 15/06* (2013.01); *E04F 2015/02105* (2013.01); *E04F 15/08* (2013.01)

(58) Field of Classification Search

CPC ..... E04F 15/02044; E04F 15/06; E04F 15/08; E04F 2015/02105; E04B 2009/186;

(Continued)

(56) References Cited

U.S. PATENT DOCUMENTS 2,924,089 A 2/1960 Reiland
3,005,292 A * 10/1961 Reiland ..... E04B 1/4107 411/116

(Continued)

FOREIGN PATENT DOCUMENTS

DE 20015523 U1 1/2001
DE 102014110192 A1 1/2016

(Continued)

OTHER PUBLICATIONS

Examination Report for Mexican Application No. Mx/a/2020/004865 completed Sep. 5, 2023.

(Continued)

*Primary Examiner* — Jessica L Laux

(74) *Attorney, Agent, or Firm* — Moore & Van Allen PLLC; Jeffrey R. Gray

(57) ABSTRACT

The decking anchors have a web anchor and a flange anchor that are operatively coupled together. In an assembly position, the web anchor and the flange anchor may be oriented in the same plane. After insertion into the cavity of the decking, the flange anchor may contact the upper flange of the decking, the web anchor may be rotated (e.g., after moving vertically upward while the flange anchor remains stationary), the web anchor may engage the webs of the decking (e.g., after moving vertically downward while the flange anchor remains stationary), and a stop may be operatively coupled to the web anchor and the flange anchor, in order to secure the web anchor and the flange anchor to each other while the web anchor contacts the webs and the flange anchor contacts the upper flange to form an anchor within the decking that has loading resistance in all directions.

8 Claims, 26 Drawing Sheets

Related U.S. Application Data

(60) Provisional application No. 62/846,321, filed on May 10, 2019.

(58) Field of Classification Search
CPC ..... E04B 5/38; E04B 5/40; E04B 9/18; E04B 9/183; E04B 9/22; E04B 9/225; E04B 9/245; E04B 9/247; E04B 9/28
See application file for complete search history.

(56) References Cited

U.S. PATENT DOCUMENTS

| | | | | |
|---|---|---|---|---|
| 4,120,231 | A * | 10/1978 | Neumayer | F16B 13/0808 411/340 |
| 4,294,570 | A | 10/1981 | Meschnig | |
| 4,545,697 | A | 10/1985 | Verdenne et al. | |
| 5,044,854 | A | 9/1991 | Oh | |
| 5,054,978 | A | 10/1991 | Kowalski | |
| 5,423,507 | A | 6/1995 | Bertrand et al. | |
| 7,241,094 | B1 * | 7/2007 | Potts | F16B 33/002 411/87 |
| 8,240,095 | B1 | 8/2012 | Meyer | |
| 2005/0034402 | A1 | 2/2005 | Johnson | |
| 2011/0174951 | A1 | 7/2011 | Sander, Jr. et al. | |
| 2015/0219141 | A1 | 8/2015 | English | |
| 2018/0347614 | A1 | 12/2018 | Reznar et al. | |
| 2019/0195251 | A1 | 6/2019 | Bodwell et al. | |
| 2020/0354972 | A1 | 11/2020 | Bogh et al. | |
| 2021/0156413 | A1 | 5/2021 | Stephan et al. | |

FOREIGN PATENT DOCUMENTS

| | | | |
|---|---|---|---|
| DE | 102014112060 | A1 | 2/2016 |
| GB | 2182369 | A | 5/1987 |
| GB | 2325257 | A | 11/1998 |
| GB | 2347693 | A | 9/2000 |
| JP | H0539647 | A | 2/1993 |
| JP | H0925653 | A | 9/1997 |
| JP | 2838695 | B2 | 12/1998 |
| JP | 2002054262 | A | 2/2002 |
| JP | 6262580 | B2 | 1/2018 |
| KR | 100270860 | B1 | 8/2000 |
| WO | 8802426 | A1 | 4/1988 |

OTHER PUBLICATIONS

Substantive Examination for Mexican Application No. MX/a/2020/004865 completed on Apr. 1, 2024.

Examination Report for Canadian Application No. 3,080,594 completed on Jan. 10, 2024.

* cited by examiner

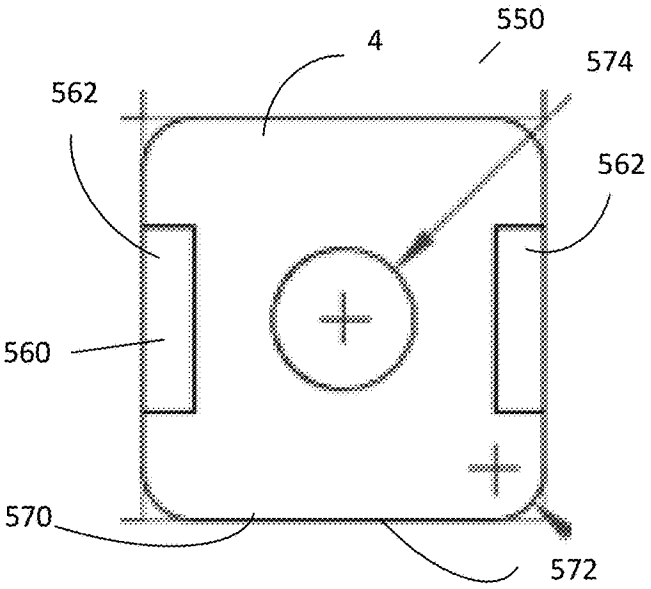
FIG. 26
FIG. 25
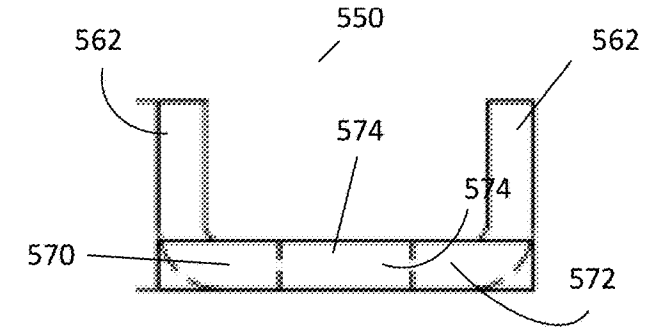
FIG. 27

*FIG.* 28

DECKING ANCHOR, DECKING SYSTEM UTILIZING THE DECKING ANCHOR, AND METHOD OF INSTALLING THE DECKING ANCHOR

CROSS REFERENCE AND PRIORITY CLAIM

The present application for a patent claims priority to co-pending U.S. patent application Ser. No. 16/867,042 entitled "Decking Anchor, Decking System Utilizing the Decking Anchor and Method of Installing the Decking Anchor," filed on May 5, 2020, which issued into U.S. Pat. No. 11,891,818 on Feb. 6, 2024, which claims priority to U.S. Provisional Patent Application Ser. No. 62/846,321 entitled "Decking Anchor, Decking System Utilizing the Decking Anchor and Method of Installing the Decking Anchor," filed on May 10, 2019, all of which are assigned to the assignees hereof and hereby expressly incorporated by reference herein.

FIELD

This application relates generally to the field of structural decking systems, and more particularly to improvements to decking anchors and decking anchor systems.

BACKGROUND

Structural panels are used in commercial or industrial construction (and in some cases residential construction), for example, as a component of poured concrete floors or as structural roofing (e.g., for commercial buildings, industrial buildings, institutional buildings, or the like). Structural panels may typically be manufactured from steel sheets, which may or may not be coiled. In order to increase the structural strength and the stiffness of the individual steel sheets, structural panels with longitudinal profiles are formed from the steel sheets via roll forming, break forming, bending, stamping, or other like processes. The structural panels are secured to each other in order to form the structural steel panel system when installed. These structural panels may be used as roof decking, floor decking, or wall panels. As such, corrugated structural panels may be used in a variety of building applications. The panels are also connected to the other load resisting structural members of a building, such as steel beams, joists, walls, other structural elements, or the like. When the panels are connected to each other in a secure manner for roof or floor applications, the assembled structural steel decking system provides considerable diaphragm (or membrane) strength, which is used to transfer horizontal loads to the vertical and lateral load carrying components of the building. The considerable diaphragm strength may be desirable in particular in geographic regions that are prone to seismic activity (e.g., earthquakes) and/or high winds. Moreover, decking anchors installed within the structural panels are used to hang components from the decking. Hanging components, such as lights, HVAC, pipes, and/or other building components, from the anchors within the structural decking (e.g., floor, ceiling or roof structural decking) can be a time intensive and multi-stepped process.

BRIEF SUMMARY

The present disclosure relates to improved decking anchors, utilizing the decking anchors within structural decking, and in particular dovetail decking, to hang components from the structural decking. The decking anchors of the present disclosure may provide for ease of installation (e.g., using one hand, or the like), ease of adding new anchors or repositioning installed anchors, and/or improved load resistance, in particular improved load resistance in the longitudinal direction along the flutes within the structural decking.

The decking anchors of the present disclosure may comprise a first portion (e.g., a web anchor) and a second portion (e.g., a flange anchor) that are operatively coupled together. In a first position (e.g., an assembly position), the web anchor and the flange anchor may be oriented in the same plane. After insertion into the cavity of the decking the flange anchor may contact the upper flange of the decking, the web anchor may be rotated (e.g., after moving vertically upward within the cavity while the flange anchor remains stationary due to the contact to with the upper flange), the web anchor may engage the webs of the decking (e.g., after moving vertically downward within the cavity while the flange anchor remains stationary), and a stop may be operatively coupled to the web anchor and the flange anchor, in order to secure the web anchor and the flange anchor to each other while the anchor contacts the webs (e.g., the web anchor) and the upper flange (e.g., flange anchor) in order to form an anchor within the decking that has loading resistance in all directions.

Embodiments of a decking anchor comprise a first anchor portion and a second anchor portion operatively coupled to the first anchor portion, and configured to move with respect to the first anchor portion. A fastener may operatively couple the first anchor portion to the second anchor portion. A stop may be operatively coupled to the fastener such that the stop impedes movement of the first anchor with respect to the second anchor when the stop is in an engaged position. In an assembly position the first anchor portion and the second anchor portion are configured to pass through an opening in a flute of decking. In an installed position the first anchor portion is configured to contact webs of the flute in the decking, and the second anchor portion is configured to contact an upper flange of the flute of the decking.

In further accord with embodiments of the invention, the first anchor portion is a web anchor and the second anchor portion is a flange anchor.

In other embodiments of the invention, the web anchor comprises opposing contact surfaces and opposing free surfaces. The opposing contact surfaces meet the flange anchor in the assembly position and the webs of the decking in the installed position.

In yet other embodiments, the invention further comprises a biasing member operatively coupled to the web anchor or the flange anchor. The biasing member aids in biasing the web anchor within the flange anchor in the assembly position or within the flute in the installed position.

In still other embodiments of the invention, the biasing member is a spring.

In other embodiments, the flange anchor comprises a base, a first support, and a second support. The first support and the second support are operatively coupled to the base and form a flange anchor aperture, and the first support and the second support are configured to contact the upper flange of the flute of the decking.

In further accord with embodiments in the invention, the web anchor is located within a flange aperture of the flange anchor. Moreover, in the assembly position a first contact surface of the web anchor contacts the first support and a second contact surface of the web anchor contacts the second support.

In other embodiments of the invention, the flange anchor further comprises a bridge operatively coupling the first support and the second support adjacent the upper flange of the flute of the decking.

In still other embodiments of the invention, the flange anchor comprises a flange fastener aperture and wherein the flange fastener aperture is configured to receive the fastener therethrough.

In yet other embodiments of the invention, the web anchor comprises a web anchor fastener aperture, and the web fastener anchor aperture is configured to receive the fastener therethrough or the web anchor is integral with the fastener.

Embodiments of a decking system comprise decking having a plurality of flutes, wherein the plurality of flutes comprise an upper flange, a portion of a first lower flange and a portion of second lower flange, and webs operatively coupling the upper flange to the first lower flange and the second lower flanges. The decking system further comprises one or more decking anchors. The one or more decking anchors comprise a first anchor portion and a second anchor portion operatively coupled to the first anchor portion. The second anchor portion is configured to move with respect to the first anchor portion. A fastener operatively couples the first anchor portion to the second anchor portion. A stop is operatively coupled to the fastener, and the stop impedes movement of the first anchor with respect to the second anchor when the stop is in an engaged position. In an assembly position the first anchor portion and the second anchor portion are configured to pass through an opening in a flute of the decking. In an installed position the first anchor portion is configured to contact the webs of the flute in the decking, and the second anchor portion is configured to contact the upper flange of the flute of the decking.

In further accord with embodiments of the invention, the first anchor portion is a web anchor and the second anchor portion is a flange anchor.

In other embodiments of the invention, the web anchor comprises opposing contact surfaces and opposing free surfaces. The opposing contact surfaces meet the flange anchor in the assembly position and the webs of the decking in the installed position.

In still other embodiments, the invention further comprises a biasing member operatively coupled to the web anchor or the flange anchor. The biasing member aids in biasing the web anchor within the flange anchor in the assembly position or within the flute in the installed position.

In yet other embodiments of the invention, the biasing member is a spring.

In other embodiments of the invention, the flange anchor comprises a base, a first support, and a second support. The first support and the second support are operatively coupled to the base and form a flange anchor aperture, and the first support and the second support are configured to contact the upper flange of the flute of the decking.

In further accord with embodiments of the invention, the web anchor is located within a flange aperture of the flange anchor. A first contact surface of the web anchor contacts the first support and a second contact surface of the web anchor contacts the second support in the assembly position.

In other embodiments of the invention, the flange anchor further comprises a bridge operatively coupling the first support and the second support adjacent the upper flange of the flute of the decking.

In still other embodiments of the invention, the flange anchor comprises a flange fastener aperture and wherein the flange fastener aperture is configured to receive the fastener therethrough. The web anchor comprises a web anchor fastener aperture, and the web fastener anchor aperture is configured to receive the fastener therethrough or the web anchor is integral with the fastener.

Embodiments of the invention comprises a method of installing an anchor in decking. The method comprises installing the anchor into a cavity of a flute within the decking with the anchor in an assembly position. The decking comprises a plurality of flutes, wherein the plurality of flutes comprise an upper flange, a portion of a first lower flange and a portion of second lower flange, and webs operatively coupling the upper flange to the first lower flange and the second lower flange. The anchor comprises a first anchor portion and a second anchor portion operatively coupled to the first anchor portion. The second anchor portion is configured to move with respect to the first anchor portion. A fastener operatively couples the first anchor portion to the second anchor portion. A stop is operatively coupled to the fastener, and the stop impedes movement of the first anchor with respect to the second anchor when the stop is in an engaged position. In the assembly position, the first anchor portion and the second anchor portion are configured to pass through an opening in a flute of the decking. The method further comprises installing the anchor into an installed position by rotating the first anchor portion with respect to the second anchor portion. In the installed position the second anchor portion is configured to contact the upper flange of the flute of the decking and the first anchor portion is configured to contact the webs of the flute in the decking.

To the accomplishment of the foregoing and the related ends, the one or more embodiments of the invention comprise the features hereinafter fully described and particularly pointed out in the claims. The following description and the annexed drawings set forth certain illustrative features of the one or more embodiments. These features are indicative, however, of but a few of the various ways in which the principles of various embodiments may be employed, and this description is intended to include all such embodiments and their equivalents.

BRIEF DESCRIPTION OF DRAWINGS

The foregoing and other advantages and features of the invention, and the manner in which the same are accomplished, will become more readily apparent upon consideration of the following detailed description of the invention taken in conjunction with the accompanying drawings, which illustrate embodiments of the invention and which are not necessarily drawn to scale, wherein:

FIG. 25 illustrates a top view of a portion of the anchor of FIGS. 23 and 24, in accordance with some embodiments of the present disclosure.

FIG. 26 illustrates an end view of a portion of the anchor of FIGS. 23 and 24, in accordance with some embodiments of the present disclosure.

FIG. 27 illustrates a side view of a portion of the anchor of FIGS. 23 and 24, in accordance with some embodiments of the present disclosure.

DETAILED DESCRIPTION

Embodiments of the present invention now may be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure may satisfy applicable legal requirements. Like numbers refer to like elements throughout.

The decking anchors of the present disclosure may comprises a first portion (e.g., a web anchor) and a second portion (e.g., a flange anchor) that are operatively coupled together. In a first position (e.g., an assembly position), the web anchor and the flange anchor may be oriented in the same plane. After insertion into the cavity of the decking the flange anchor may contact the upper flange of the decking, the web anchor may be rotated (e.g., after moving vertically upward within the cavity while the flange anchor remains stationary due to the contact to with the upper flange), the web anchor may engage the webs of the decking (e.g., after moving vertically downward within the cavity while the flange anchor remains stationary), and a stop may be operatively coupled to the web anchor and the flange anchor, in order to secure the web anchor and the flange anchor to each other while the anchor contacts the webs (e.g., the web anchor) and the upper flange (e.g., flange anchor) in order to form an anchor within the decking that has loading resistance in all directions.

Figure 1:
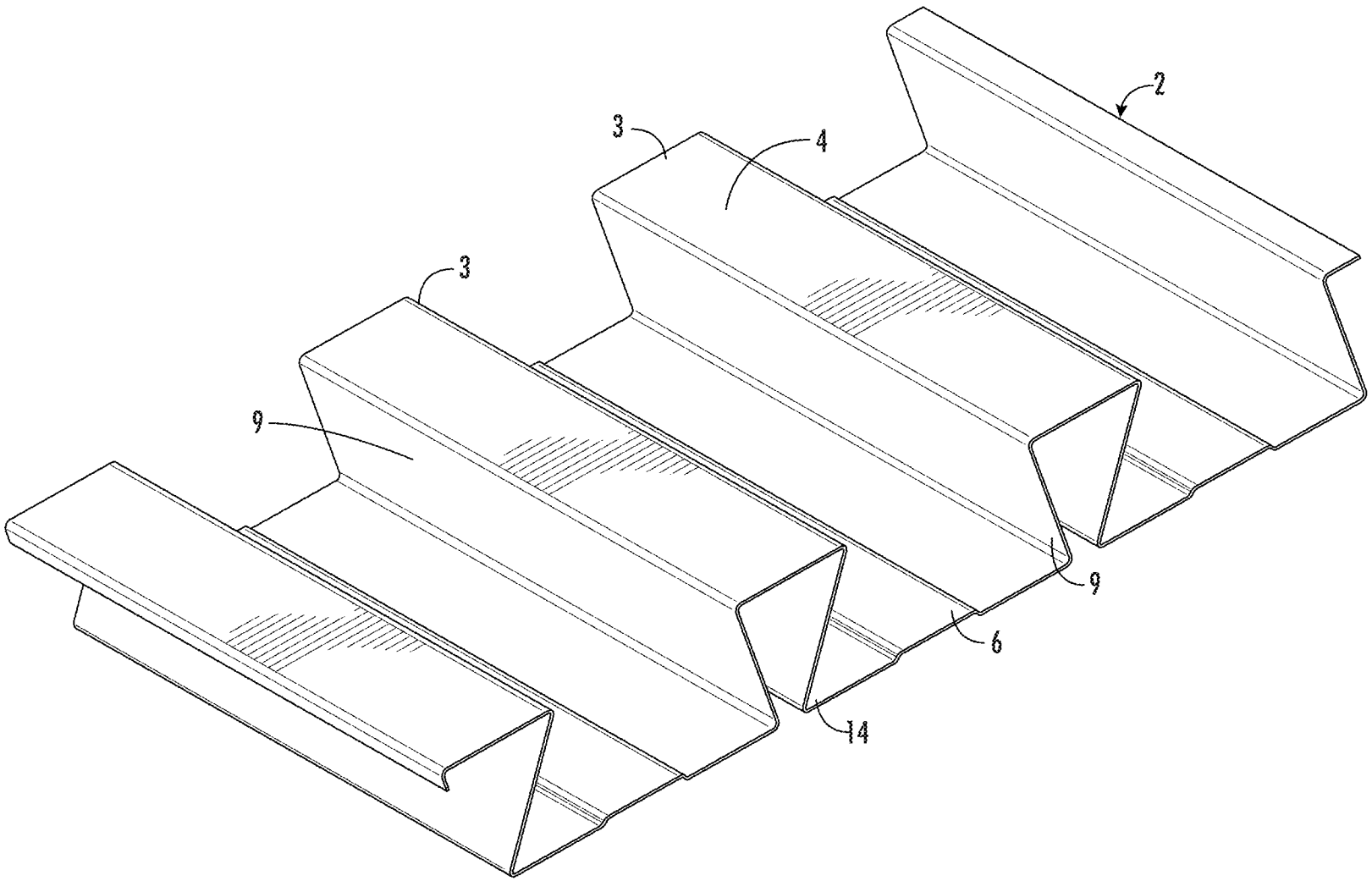
FIG. 1 illustrates a perspective view a dovetail decking panel, in accordance with some embodiments of the present disclosure.
Figure 2:
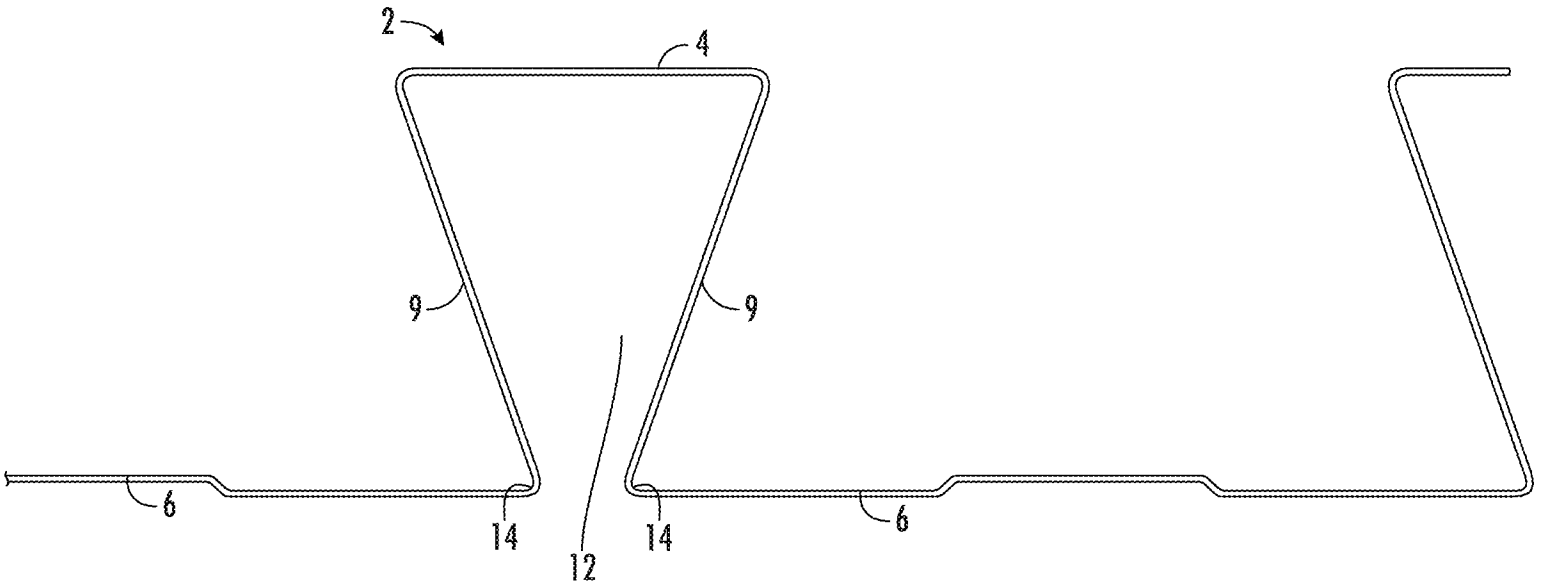
FIG. 2 illustrates a side cross-sectional view of the dovetail decking panel illustrated in FIG. 1, in accordance with some embodiments of the present disclosure.

FIGS. 1 and 2 illustrate a structural decking panel 2 (otherwise referred to herein as a "panel", "structural panel", "decking", or "structural decking"), and in particular, a dovetail structural decking panel 2. As will be described herein, the use of the dovetail decking along with the embodiments of the anchor 100 described herein provides improved decking anchor systems 50 that allow for improved installation, repositioning, and improved load resistance, and in particular improved load resistance along the longitudinal direction of the flute, when compared to traditional anchors and decking anchor systems. The decking system 50, including the decking 2 and the anchors 100 may be manufactured from a variety of rigid materials including steel, aluminum, titanium, plastic, a composite, or another type of rigid material. Typical structural decking panels 2 are made of steel and are sized in ranges from 12 inches to 42 inches wide by 1 foot to 50 feet long. These dimensions include some sizes of structural decking panels 2, but it should be understood that the structural decking panels 2 may be sized within these ranges, overlapping these ranges, or outside of these ranges and utilized with the present invention. The material thickness of the structural decking panels 2 may be any thickness; however, typical panel thicknesses may range from 29 gage panels to 16 gage panels, inclusive (or up to 14 gage, inclusive). Other material thicknesses of the present invention may be within this range, overlap this range, or be located outside of this range.

As illustrated throughout the figures, the structural decking panels 2 may have a dovetail decking profile that include top flanges 4 (otherwise described as peaks, upper flanges, outer flanges, or the like), bottom flanges 6 (otherwise described as troughs, lower flanges, inner flanges, or the like), and webs 9 (e.g., the portions of the panel that may be straight or sloped between the flanges 4, 6) that operatively couple the top flanges 4 to the bottom flanges 6, all of which will be generally discussed in further detail below. The combination of top flange 4, bottom flanges 6 (or portions of multiple bottom flanges adjacent the top flange 4), and the webs 9 create a flute 3 for the structural decking panels 2. It should be understood that each decking panel 2 may comprise multiple flutes 3. The distance from the top of the top flange 4 and the bottom of the bottom flange 6 may generally range from a ½ inch to 1, 2.5, 3, 3.5, 4.5, 5, or the like inches in depth; however, other ranges of depths within this range, overlapping this range, or outside of this range may be used in the profiles. For example, in some embodiments the distance may range from ½ inch to 12 inches in depth, or the like. The decking panels 2 may or may not include longitudinal ribs, bends, or cutouts that impact the moment of inertia and section modulus of the panels 2 (e.g., profile dimensions, ribs, cutouts, or the like are used to target different performance characteristics, such as but not limited to strength and/or stiffness). Depending on the material thickness, the length and width of the decking panels 2, and the height of the top flanges 4 and bottom flanges 6, the decking panels 2 may weigh between 100 and 420 lbs. In other embodiments, the weight of the panels 2 may be within, overlap, or be located outside of this range.

Structural decking panels 2 may be operatively coupled to each other through the use of sidelaps. The sidelaps may be any type of sidelap, such as but not limited to an overlapping sidelap, a standing sidelap seam, a nested sidelap, a sidelap using a reinforcing member, or any other sidelap connector in which one panel edge is operatively coupled to another edge. For example, panel edges (e.g., the opposite longer sides of the structural panel 2) may be formed into lips that couple a first structural decking panel 2 to an adjacent second structural decking panel 2. The lips on opposite edges of a structural panel 2 may include a "lower lip" 10 and an "upper lip" 12, which may overlap, overlay each other, nest with respect to each other, or the like. Couplings (also described as joints, connections, attachments, or the like) may be formed in the sidelaps of the structural decking panels 2 to couple adjacent structural panels 2 to each other.

The sizes and thicknesses of the structural decking panels 2 are determined based on the engineering requirements for the desired application of the structural panel systems. In one particular embodiment of the invention, the structural decking panels 2 are used as floors and/or roofs within a building, and are required to meet the structural requirements for withstanding loading, such as potential seismic activity, high winds, and/or other natural or man-made forces. Moreover, the anchors that are used to install building components (e.g., pipes, vents, ducts, equipment, or the like) must also be able to resist different types of loading in multiple directions, such as seismic activity, high winds, and/or other natural forces, and/or man-made forces related to use of the structure itself.

Figure 7:
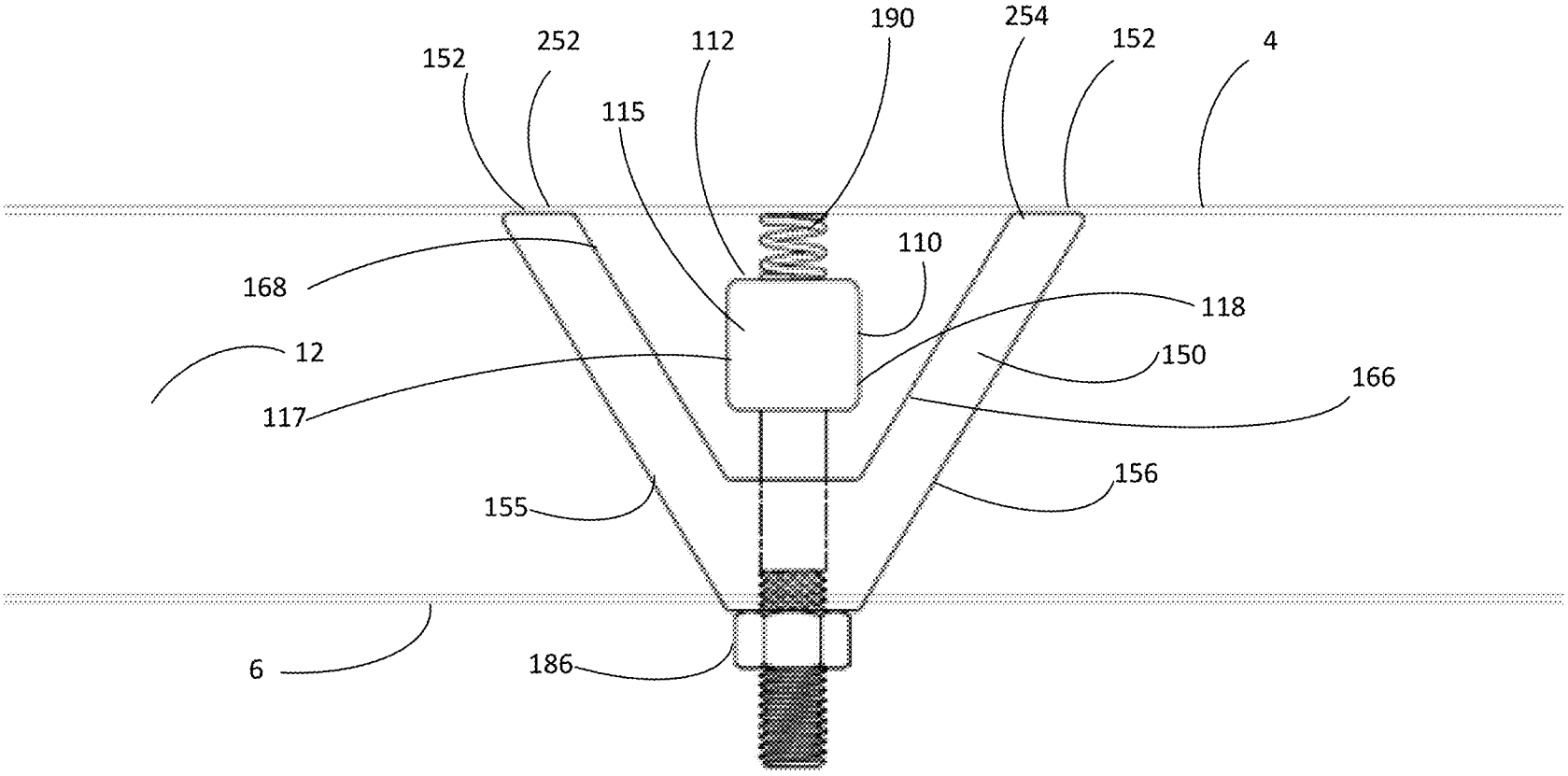
FIG. 7 illustrates a side cross-sectional view of an anchor in an installed position, in accordance with some embodiments of the present disclosure.
Figure 9:
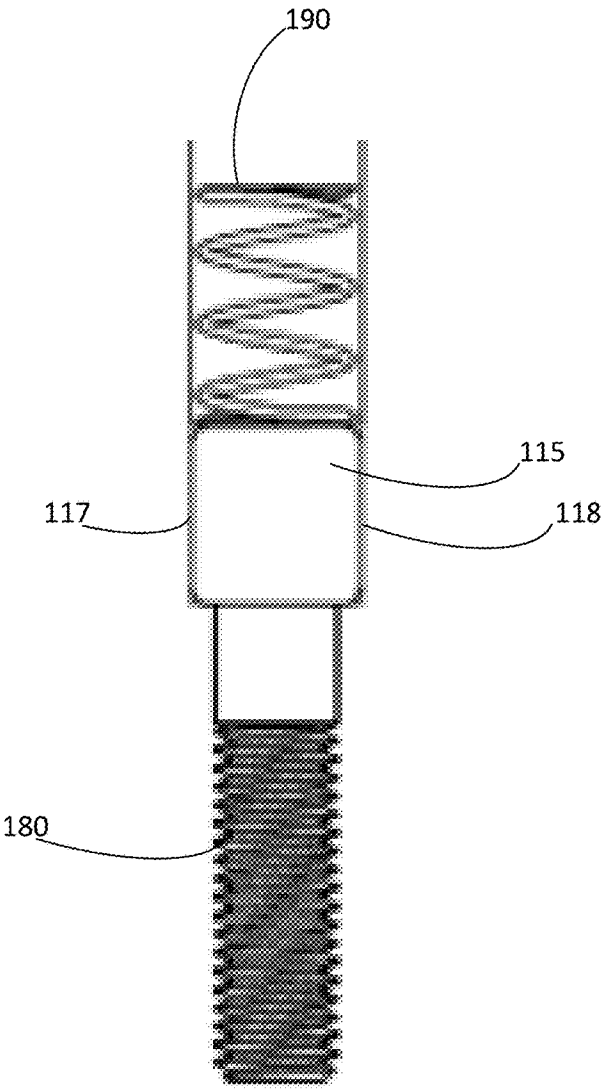
FIG. 9 illustrates a second side view illustrating a contact surface of a web anchor of the anchor in FIG. 7, in accordance with some embodiments of the present disclosure.
Figure 8:
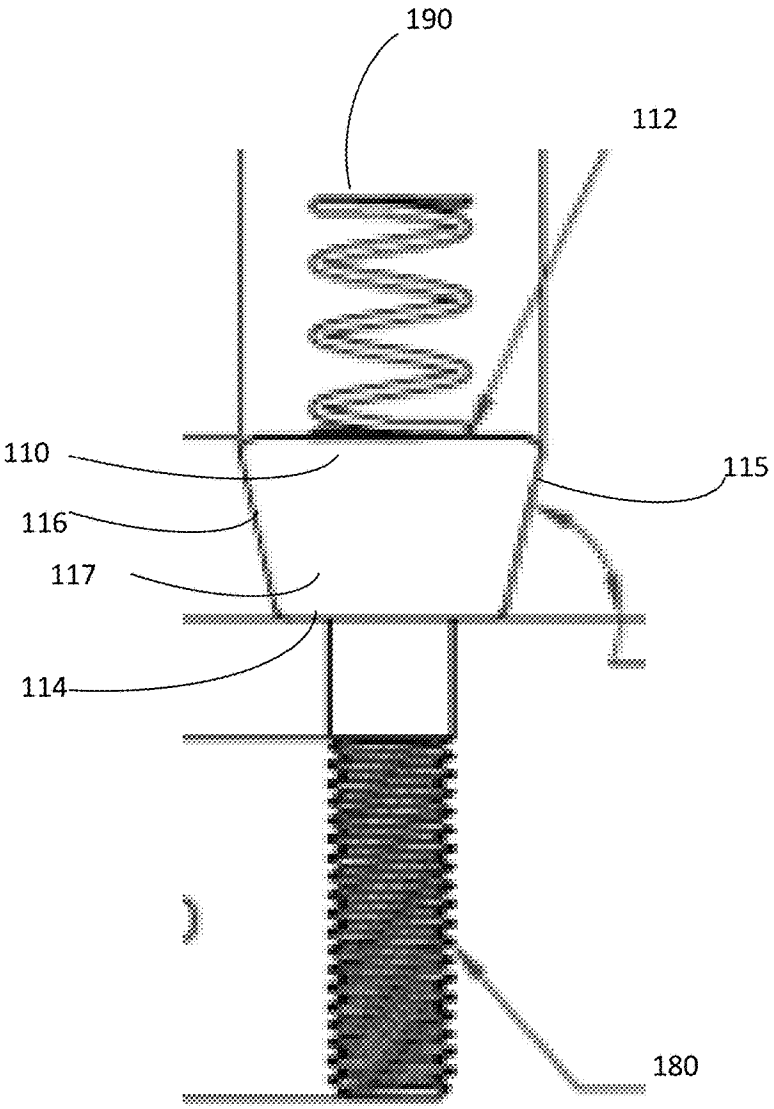
FIG. 8 illustrates a first side view illustrating a free surface of a web anchor of the anchor in FIG. 7, in accordance with some embodiments of the present disclosure.
Figure 10:
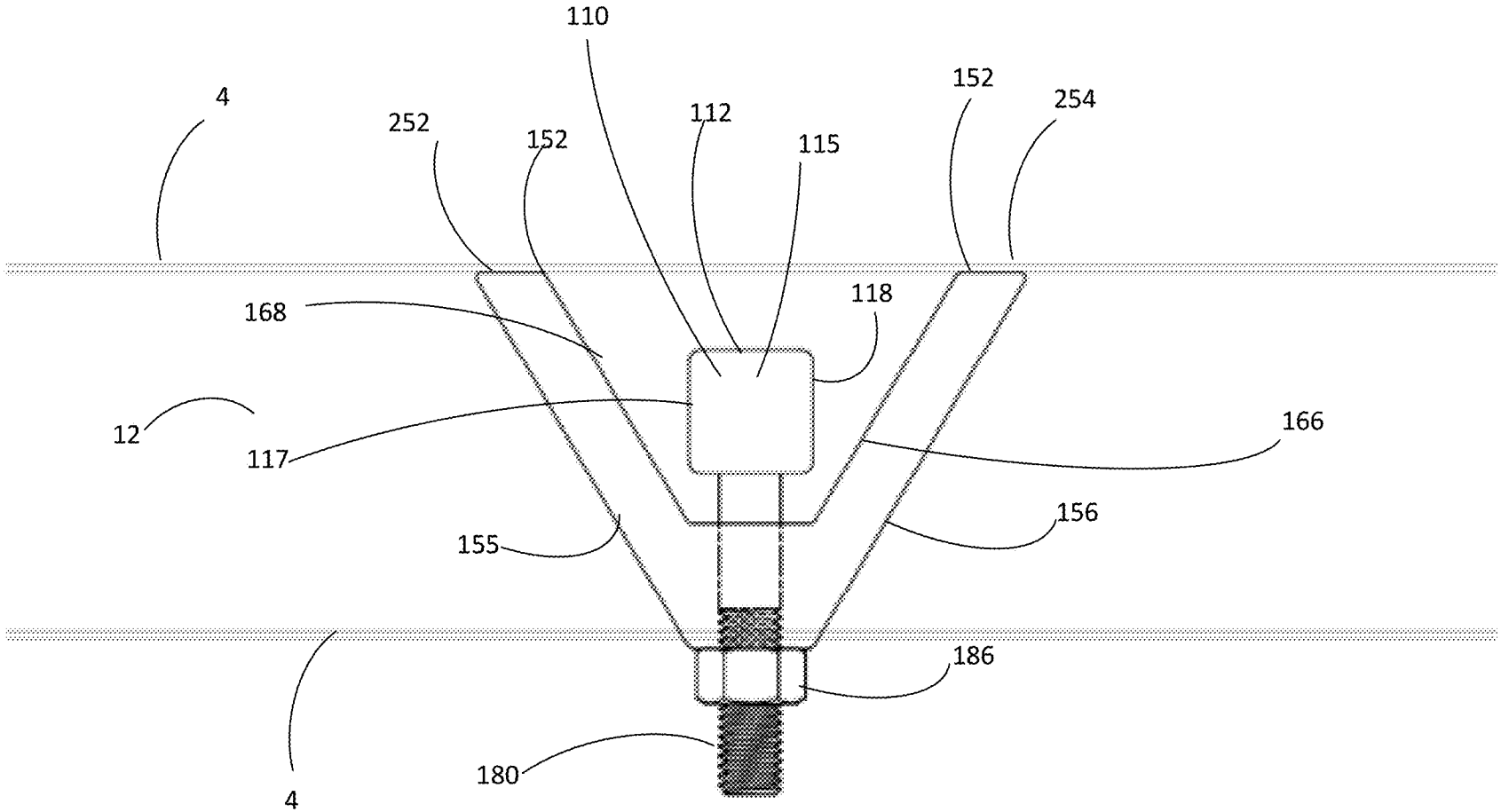
FIG. 10 illustrates a side cross-sectional view of an anchor in an installed position, in accordance with some embodiments of the present disclosure.
Figure 15:
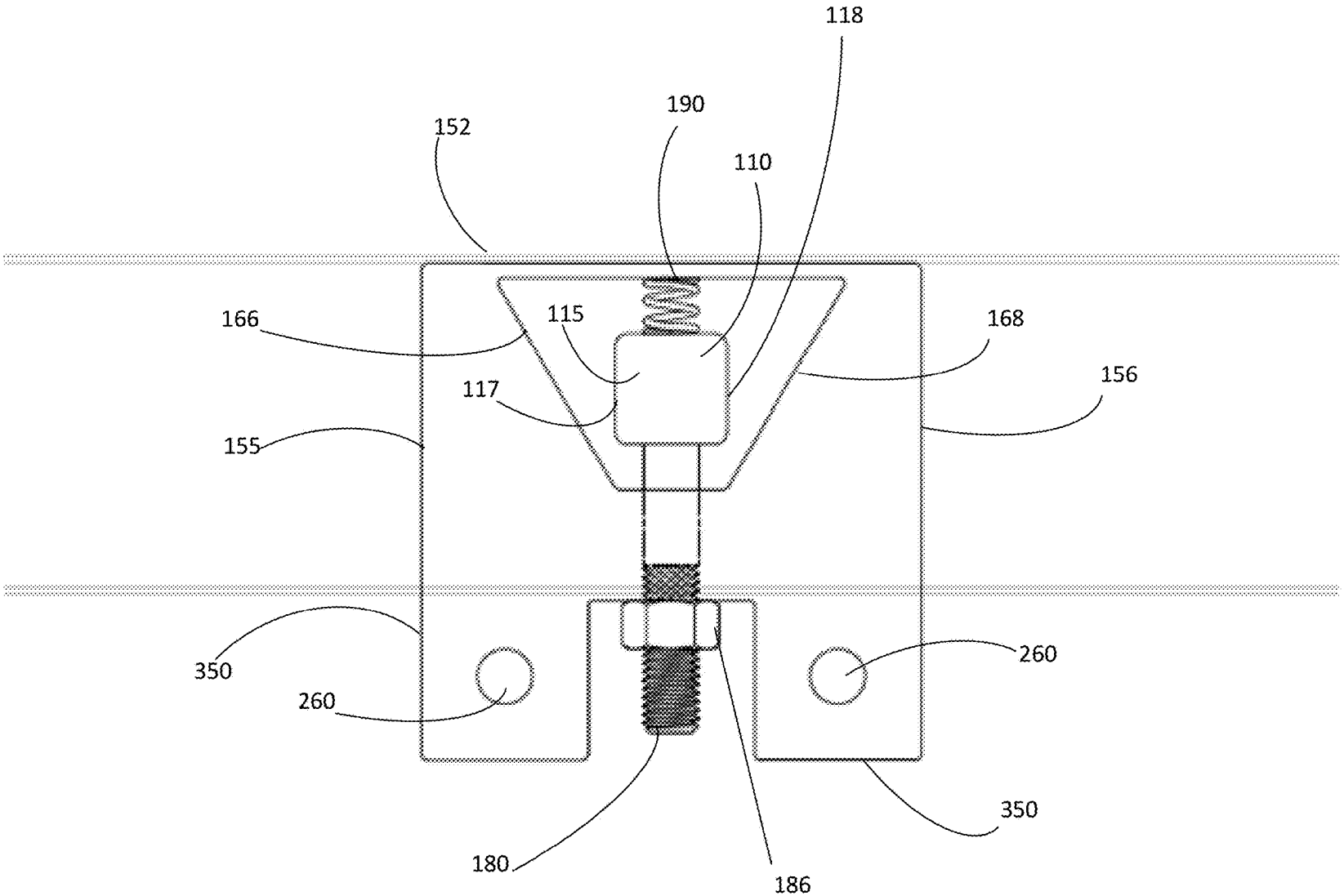
FIG. 15 illustrates a side cross-sectional side view of an anchor in an installed position within the dovetail decking having multiple hanger locations, in accordance with some embodiments of the present disclosure.
Figure 16:
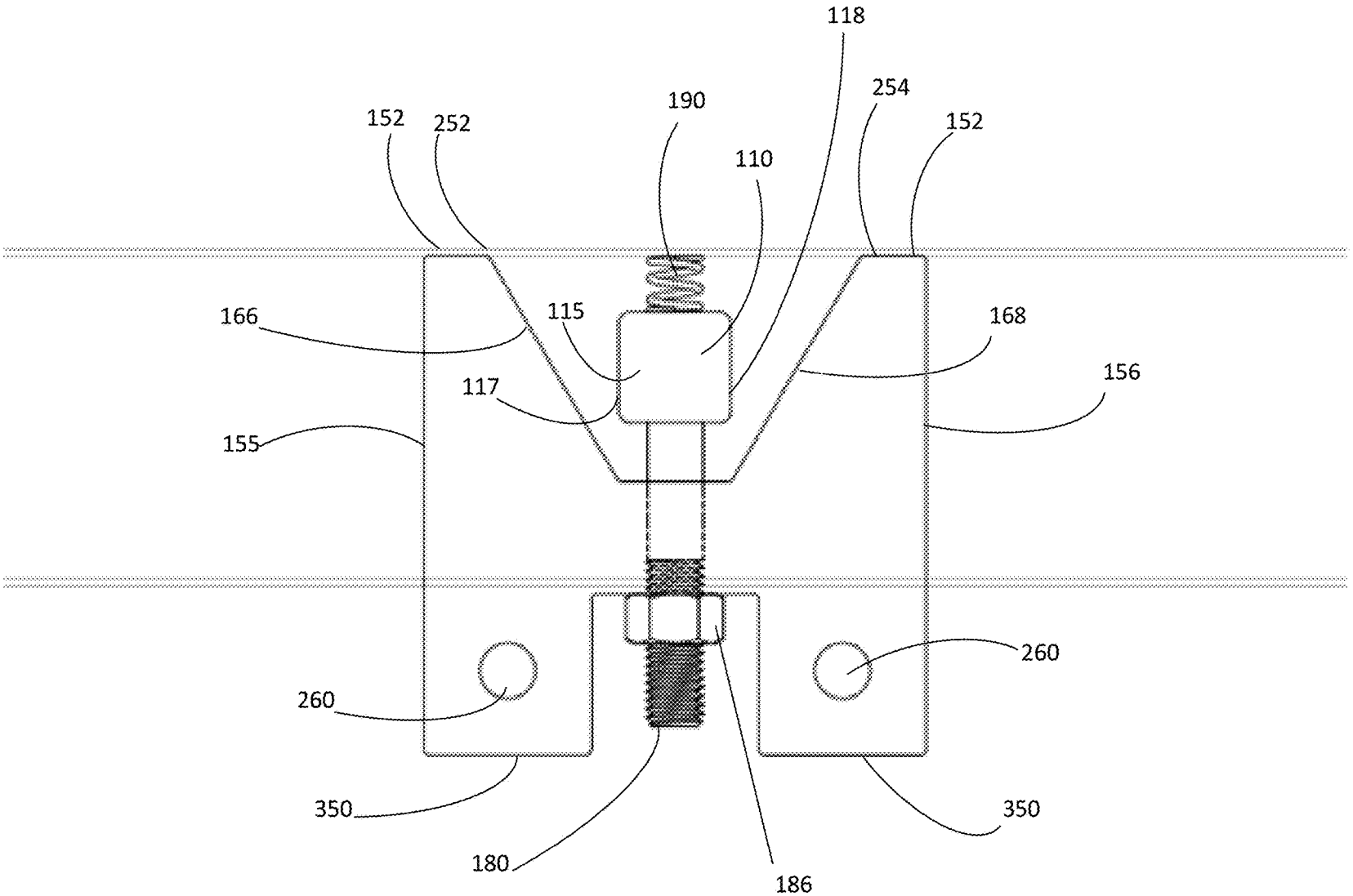
FIG. 16 illustrates a side cross-sectional side view of an anchor in an installed position within the dovetail decking having multiple hanger locations, in accordance with some embodiments of the present disclosure.
Figure 17:
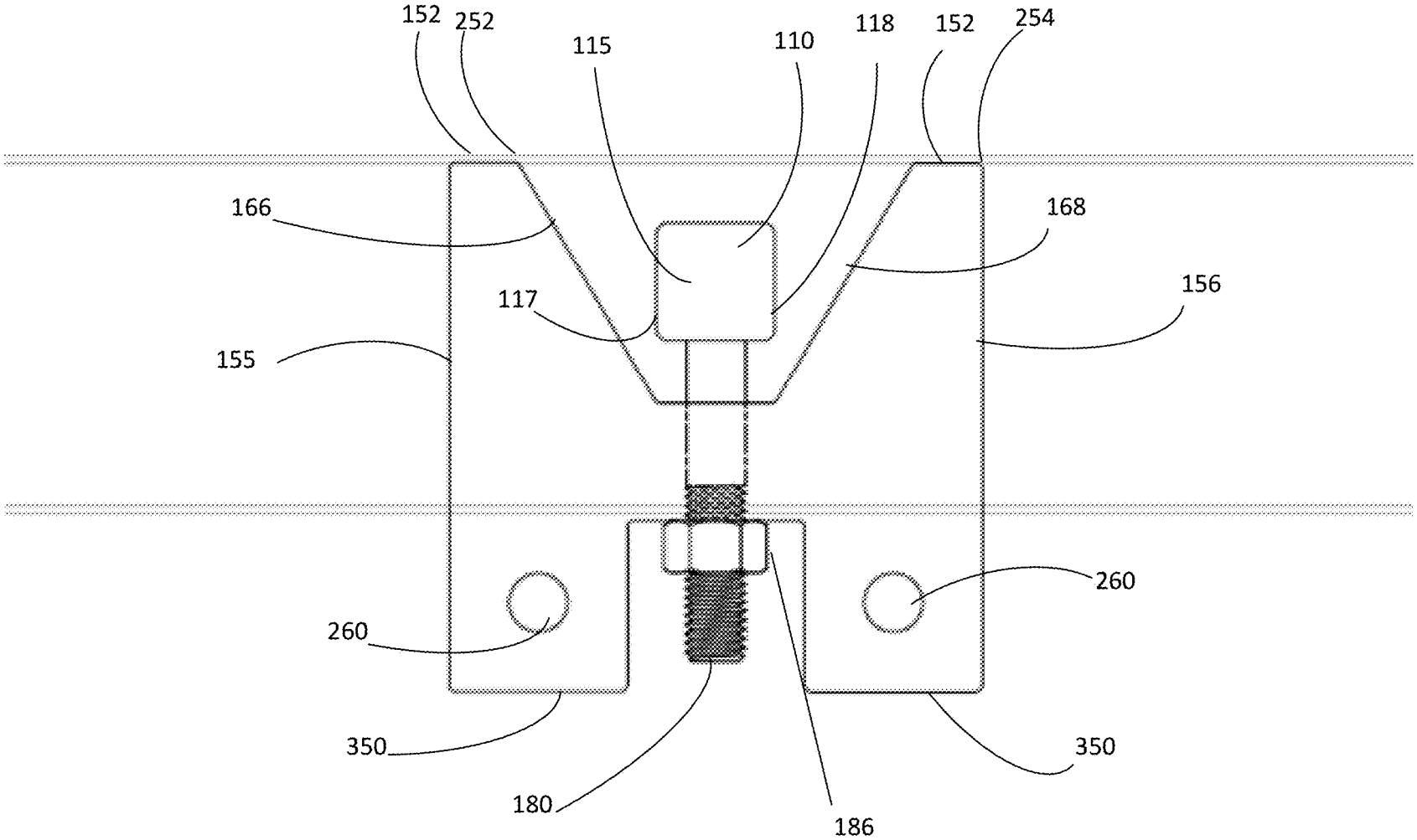
FIG. 17 illustrates a side cross-sectional side view of an anchor in an installed position within the dovetail decking having multiple hanger locations, in accordance with some embodiments of the present disclosure.

FIGS. 3 through 23 illustrate different embodiments of the anchor 100 and decking anchor system 50, which will be described in further detail herein. FIGS. 3 through 6 illustrate embodiments of the anchor 100 and the decking anchor system 50 in which a first anchor portion 110 (e.g., a web anchor) is located within a second anchor portion 150 (e.g., a flange anchor having a closed flange anchor aperture 160). FIGS. 7 through 9 illustrate other embodiments of the anchor 100 and decking anchor system 50 in which a first anchor portion 110 is located within a second anchor portion 150 (e.g., a flange anchor having an open flange anchor aperture 160). FIG. 10 illustrates an alternate embodiment of the anchor 100 without a biasing member 190. FIGS. 11 through 14 illustrate various embodiments of the invention in which the second anchor portion 150 comprises one or more additional hanging locations 260 (e.g., vertical borehole—threaded boreholes). FIGS. 15 through 17 illustrate various embodiments of the invention in which the second anchor portion 150 comprises one or more additional hanging locations 260 (e.g., horizontal boreholes—for pins, or the like). FIGS. 19 through 21 illustrate other embodiments of the invention, in which the second anchor portion 150 comprises one or more projections 450 that restrict the rotation of the first anchor portion 110). FIG. 22 illustrated a perspective installed view of the anchor 100 within a decking anchor system 50. FIGS. 23 through 27 illustrate alternate embodiments of an anchor 500 that may be used within a decking anchor system 50.

Returning to FIGS. 3 through 6, the first anchor portion 110 (e.g., a web anchor) and a second anchor portion (e.g., flange anchor) are illustrated. It should be understood that the web anchor 110 and the flange anchor 150 may be operatively coupled to each other, but move independently with respect to each other, as will be discussed throughout the specification. It should be further understood, that during assembly the web anchor 110 and the flange anchor 150 may be in an assembly position that allows the anchor 100 to be inserted into a cavity 12 of the decking 2 (e.g., dovetail decking). A portion of the flange anchor 150 engages a portion of the flute 3 (e.g., upper flange 4) of the decking 2, and thereafter, the web anchor 110 may be rotated with respect to the flange anchor 150 (e.g., approximately 90 degrees), in some embodiments after being further extended into the cavity 12, and engages the webs 9 of the decking 2, as will be discussed in further detail herein.

It should be understood that the web anchor 110 may comprise a wedge nut of any shape and/or size. It should be understood that the web anchor 110 may be a trapezoid shape and/or any other type of uniform or non-uniform shape. In some embodiments, the web anchor 110 may comprise an upper web anchor surface 112, a lower web anchor surface 114, opposing web anchor contacting surfaces 115, 116 (e.g., a first web anchor contacting surface 115 and a second web anchor contacting surface 116), and opposing web anchor free surfaces 117, 118 (a first web anchor free surface 117, and a second web anchor free surface 118). In some embodiments the web anchor may have one or more web anchor apertures 120. The one or more web anchor apertures 120 may extend partially or completely through the web anchor aperture 120, such as partially into the upper web anchor surface 112, the lower web anchor surface 114, or from the upper web anchor surface 112 through lower web anchor surface 114. It should be further understood that the surfaces described herein 112,

114, 115, 116, 117, 118 of the web anchor 110 may be plane surfaces or may have another shape, such as a convex, concave, non-uniform, or other like shape. It should be further understood that the surfaces may be continuous and/or discontinuous, and as such, may have surfaces that are from projections within and/or extending from the surfaces illustrated in the figures. As such, the opposing web anchor contacting surfaces 115, 116 and the opposing web anchor free surfaces 117, 118 may extend between the upper web anchor surface 112 and the lower web anchor surface 114 as illustrated in the figures, or may not extend continuously between the upper web anchor surfaces 112 and the lower web anchor surface 114 (not illustrated).

The flange anchor 150 may comprise a flange base 140, a first flange support 142, and a second flange support 144 extending from the flange base 140. In some embodiments, as will be discussed with respect to other embodiments, the first support 142 and the second support 144 may be operatively coupled together through the use of a flange bridge 146. As such, the flange anchor may comprise one or more upper flange anchor surfaces 152, one or more lower flange anchor surfaces 154, one or more flange anchor sides (e.g., opposing first and second flange anchor sides 155, 156, and opposing third and fourth flange anchor sides 157, 158). The one or more upper flange anchor surfaces 152 as illustrated in FIGS. 3 through 6 may comprise a single surface (or multiple surfaces as will be described in further detail later) that extends between the first and second flange anchor sides 155, 156. The flange anchor 150 may have a flange anchor aperture 160. In some embodiments, the flange anchor aperture 160 may be formed by the flange base 140, the first flange support 142, and the second flange support 144, and/or the flange bridge 146. Moreover, the flange aperture 150 may comprise one or more flange anchor aperture surfaces (e.g., a lower flange aperture surface 162, an upper flange aperture surface 164, and first and second opposing flange aperture surfaces 166, 168). The flange anchor aperture 160 may receive and house the web anchor 110 and allow and/or prevent movement between the web anchor 110 and the flange anchor 150 (e.g., vertical—up and down, and rotational). The flange anchor 150 may further comprise a flange fastener aperture 170.

As illustrated in FIGS. 3 through 6, the anchor system and/or the anchor 100 may further comprise a fastener 180 with a first end 182 (e.g., proximate end) and a second end 184 (e.g., a distal end), a stop 186 (e.g., a nut, or the like), a washer 188, a biasing member 190 (e.g., a spring, or the like). It should be understood that the web anchor 110 may be operatively coupled to the flange anchor 150, such that the web anchor 110 is received within at least a portion of the flange anchor 150 (e.g., the flange anchor aperture 160). In some embodiments, a first end 182 of the fastener 180 may be removably operatively coupled to the web anchor 110, such as threaded into a web anchor aperture 120, inserted through the web anchor aperture 120 and secured (e.g., through a nut, the biasing member 190, or the like), and/or secured through any other type of coupling. In other embodiments, as will be discussed in further detail herein, the fastener 180 may be made permanently operatively coupled to the web anchor 110 such as through welding, brazing, press-fitting, or the like, and/or machined into web anchor 110. It should be further understood that the fastener 180 may be any type of member, such as but not limited to a rod, screw, bolt, rivet, or the like of any shape, such as circular, oval, square, any polygonal shape, or the like.

Figure 3:
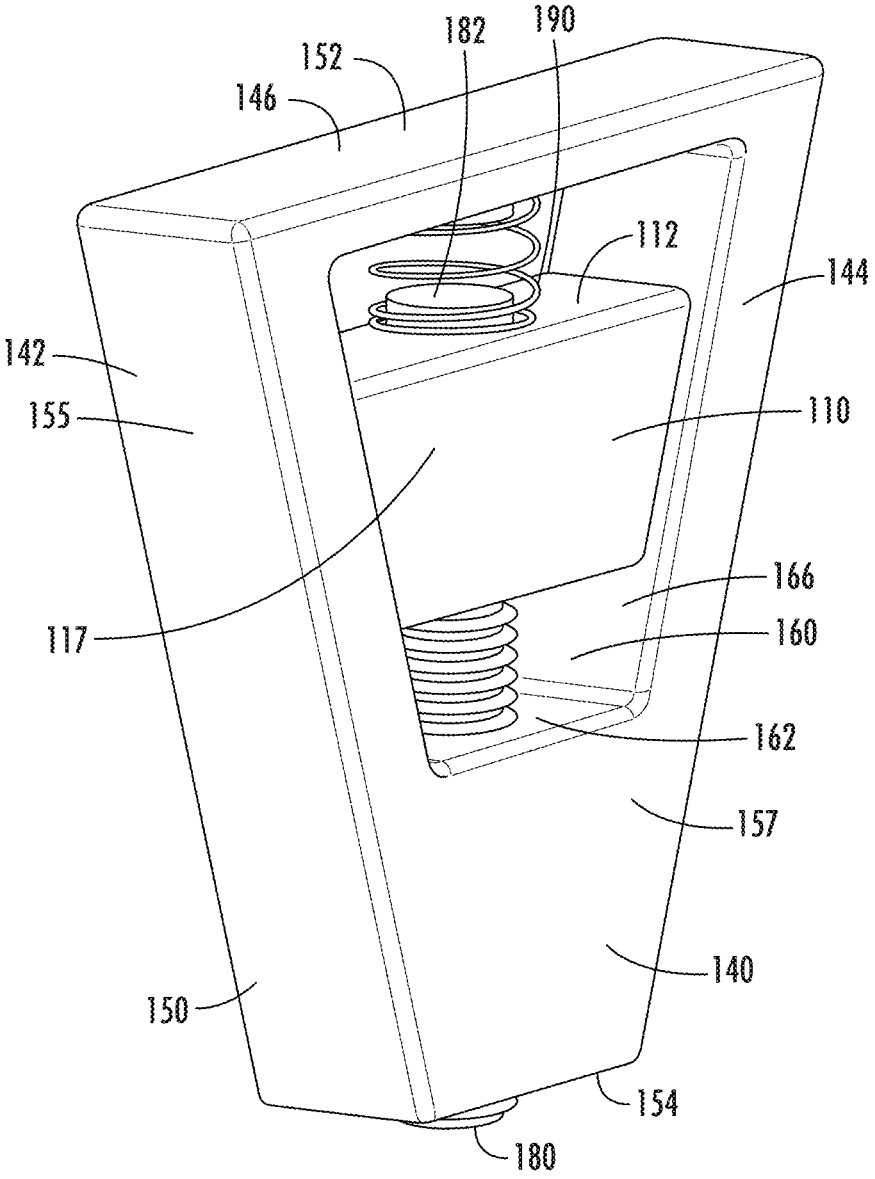
FIG. 3 illustrates a perspective view of an anchor in an assembly position within the dovetail decking, in accordance with some embodiments of the present disclosure.
Figure 4:
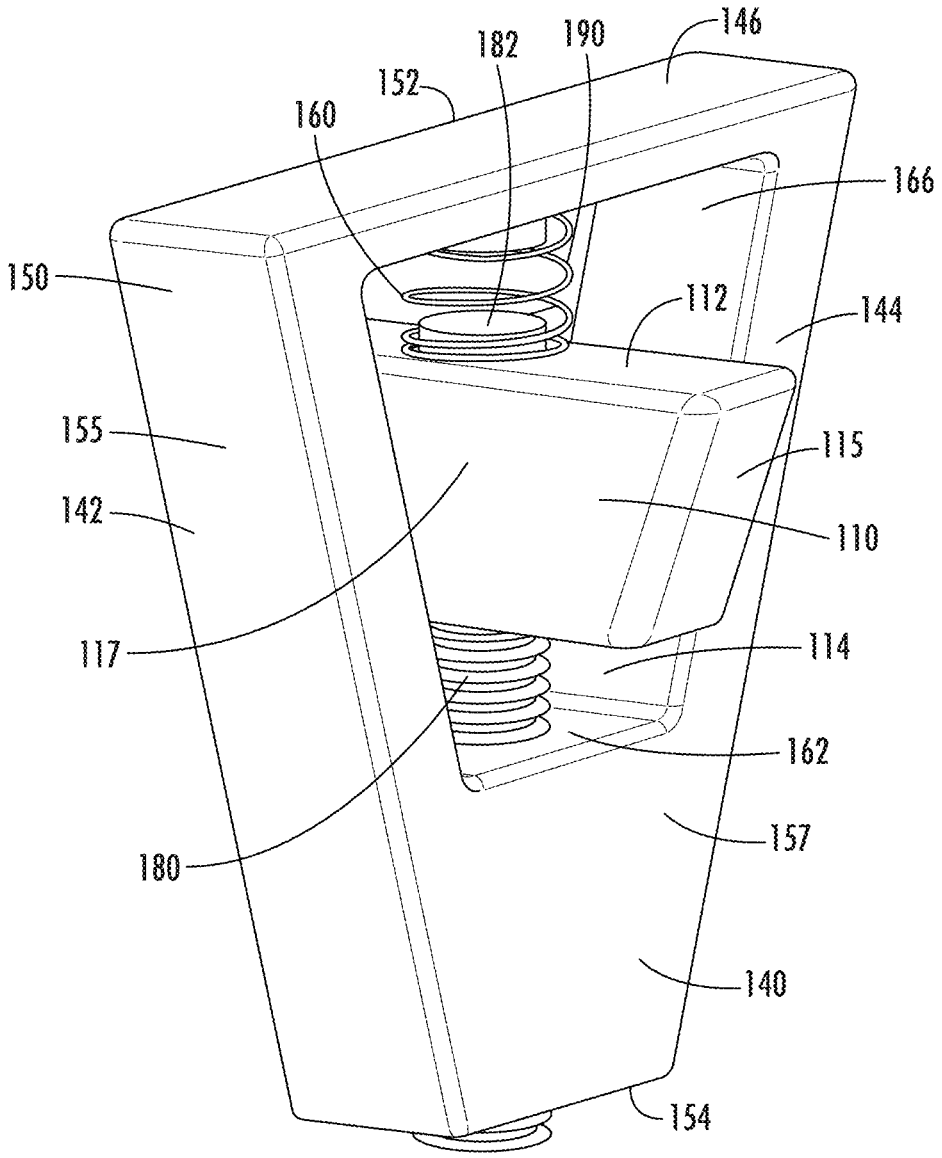
FIG. 4 illustrates perspective view of an anchor in an installed position within the dovetail decking, in accordance with some embodiments of the present disclosure.

The anchor 100 may be adjustable, such that a least a portion of the anchor 110 may be positioned in two or more orientations. For example, in a first position (e.g., an assembly position as illustrate in FIG. 3) at least a portion of the opposing web anchor contacting surfaces 115, 116 (or the entire surfaces) may contact a portion of the one or more flange aperture surfaces, such as a second flange aperture surface 166 and a third flange aperture surface 168. The lower web anchor surface 114 may or may not contact the first flange aperture surface 162. Should the lower web anchor surface 114 contact the first flange aperture surface 162, at least a portion of the surfaces may contact or all of the surfaces may contact each other. Moreover, it should be understood that in the first position, the opposing web anchor free surfaces 117, 118 may (as shown in FIG. 3) or may not be parallel and in plane with the third and fourth opposing flange anchor sides 157, 158. During assembly of the anchor 100 with the decking 2, the anchor 100 is inserted into a cavity 12 of the decking 2. For example, the anchor 100 may be inserted into the cavity 12 such that the opposing web anchor free surfaces 117, 118 and the third and fourth opposing flange anchor sides 157, 158 run longitudinally along with the cavity 12 of the decking 2. The anchor 100 is inserted into the cavity 12 until the one or more upper flange anchor surfaces 152 contact a surface of the upper flange 4 (e.g., internal surface of the upper flange 4) of a flute 3 of the decking 2. Once the one or more upper flange anchor surfaces 152 contact upper flange 4, the biasing member 190 allows the web anchor 110 to move vertically with respect to the flange anchor 150. That is, the flange anchor 150 remains stationary, while the web anchor 110 continues to move towards the upper flange 4 of the decking 2, as a user pushes on the fastener 180. In this way, the one or more web anchor surfaces (e.g., the opposing web anchor free surfaces 117, 118, and in some embodiments the lower web anchor surface 114) separate from the one or more aperture surfaces (e.g., the opposing first and second flange aperture side surfaces 166, 168, and in some embodiments the lower flange aperture surface 162).

Once the web anchor 110 is separated from contact with the flange anchor 150 (e.g., the one or more web anchor surfaces are separated from contact with the one or more flange aperture surfaces), the web anchor 110 has the ability to rotate with respect to the to the flange anchor 150, while the flange anchor 150 remains stationary. For example, the opposing third and fourth flange anchor sides 157, 158 are restricted from rotating within in the cavity 12 by a portion of the decking 2, such as a portion of the webs 9 and/or lower flanges 6 (e.g., decking corners 14 wherein the webs 9 and/or lower flanges 6 meet), and/or by the contact between the upper flange 6 of the decking 2 and the one or more upper flange anchor surfaces 152. As such, the web anchor 110 may be rotated approximately ninety (90) degrees into a second position (e.g., an installed position), such that the plane of the opposing web anchor free surfaces 117, 118 are perpendicular with the plane of the third and fourth opposing flange anchor sides 157, 158, as illustrated in FIG. 6.

Figure 5:
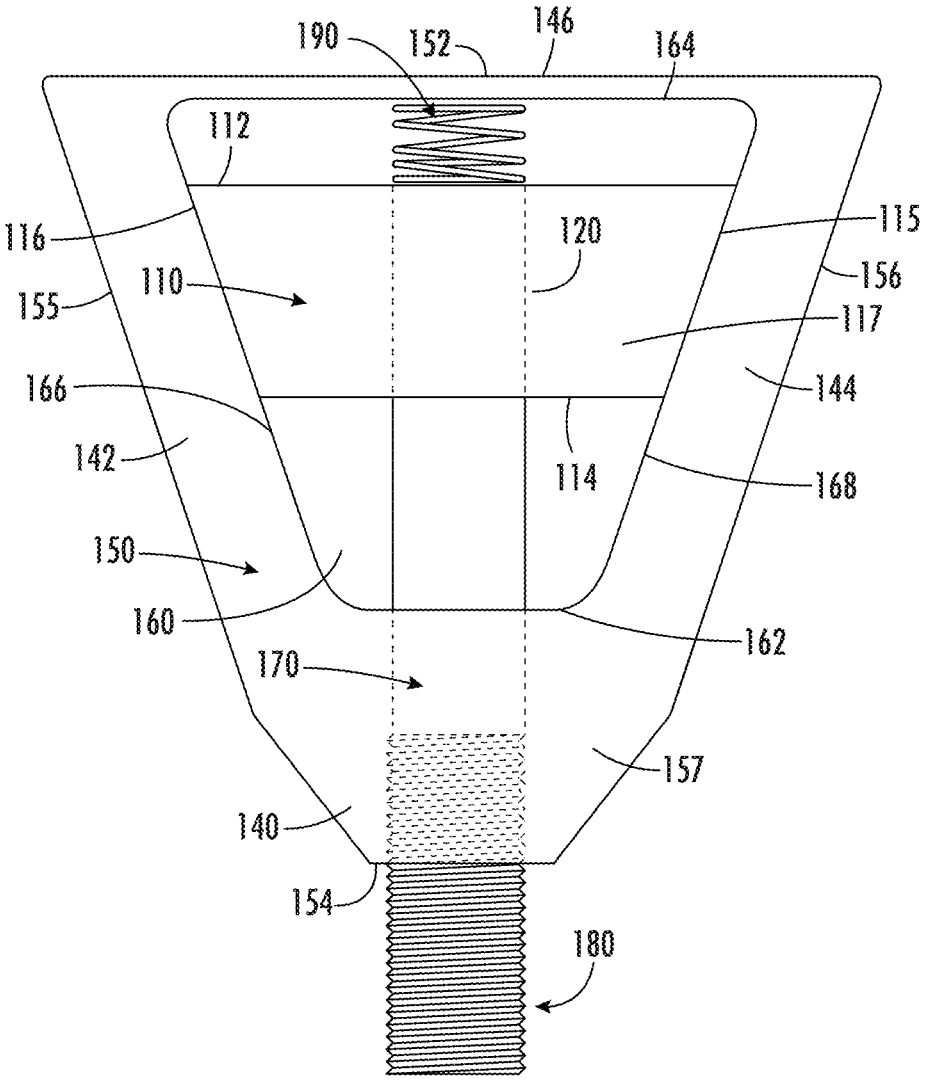
FIG. 5 illustrates a side cross-sectional view of an anchor in an assembly position, in accordance with some embodiments of the present disclosure.
Figure 6:
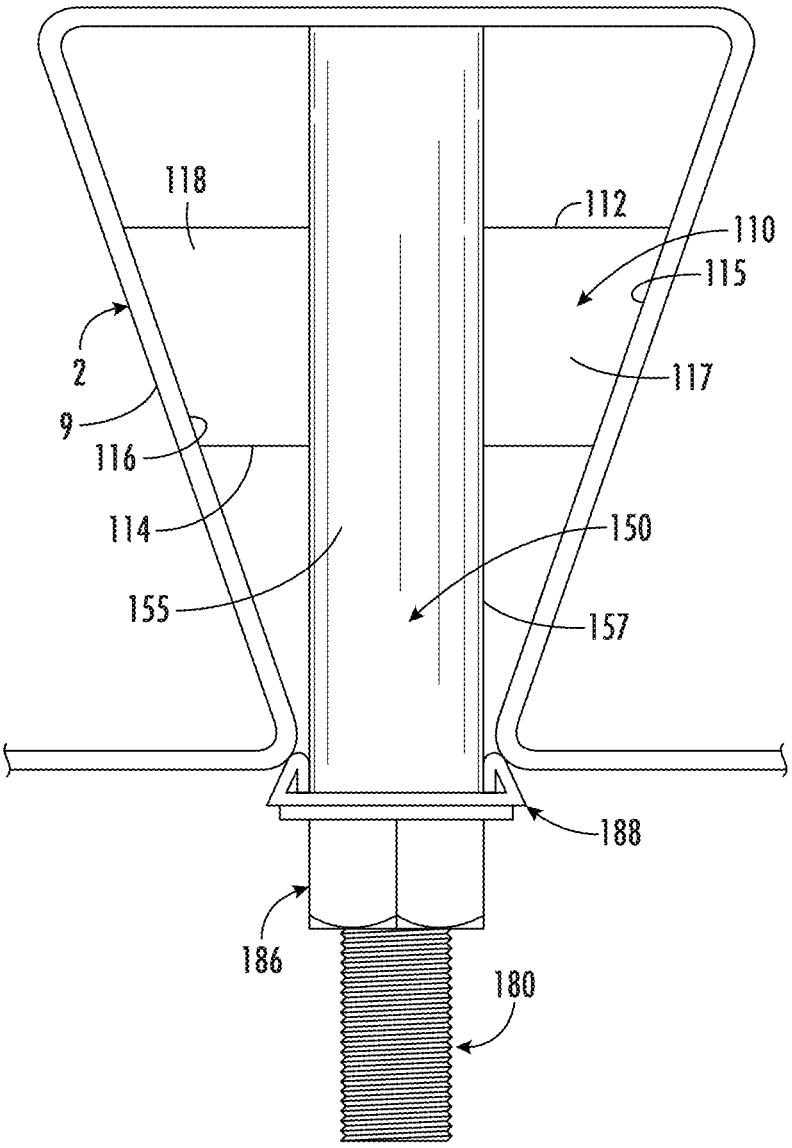
FIG. 6 illustrates an end view the anchor in an installed position within the dovetail decking, in accordance with some embodiments of the present disclosure.

It should be further understood that in some embodiments a biasing member 190 may be used to bias the web anchor 110 against the flange anchor 150 (e.g., against the first and second flange aperture side surfaces 166, 168) in the assembly position as illustrated in FIG. 5, and/or against the webs 9 of the decking 2 in the installed position as illustrated in FIG. 6. Alternatively, or additionally, an installer may utilize a stop 186, such as a nut or other like feature to install the anchor system 50. For example, an installer may utilize the stop to draw the web anchor 110 lower vertically while the flange anchor 150 remains stationary. That is, for example, as the nut is rotated (e.g., clockwise), the nut will move up the fastener, engage the lower flange surface 154 or a component there between (e.g., a washer 188, or the like), then through continued rotation the fastener 180 will be moved vertically downward, which draws the web anchor 110 downward. The stop 186 is used until at least a portion of (or all of) the opposing web contacting surfaces 115, 116 contact the interior surfaces of the webs 9 within the cavity 12 of the decking 2, for example, as illustrated in FIG. 6. As such, the fastener 180 and the stop 186 are used to bias the web anchor 110 with respect to the flange anchor 150, the web anchor 110 against the webs 9, and the flange anchor 150 against the internal surface of the upper flange 4 of the decking 2.

While FIGS. 3 through 6 illustrate some embodiments of the anchor 100, it should be understood that different embodiments of the anchor 100 are discussed herein, in which the flange anchor 150 may not have an enclosed flange aperture 160 (e.g., no upper flange aperture surfaces 164), may have two or more upper flange anchor surfaces 152, may have a biasing member 190 located in different locations of the anchor 100, may not have a biasing member 190, may have multiple hanging locations in the flange anchor 150, may have a fastener 180 that is integral with the web anchor 110, or the like, as will be described in further detail below.

As illustrated in FIGS. 7 through 9, in some embodiments of the invention, the web anchor 110 may be integrally operatively coupled with the fastener 180. For example, the web anchor 110 may be machined, cast, or the like to include the fastener 180 (e.g., the rod, a threaded fastener, or the like). Alternatively, the fastener may be press fit, welded, brazed, or the like with the web anchor fastener 120, thereby forming a web anchor 110 including a permanently operatively coupled fastener 180. Moreover, as illustrated in FIGS. 7 through 9, the biasing member 190 may comprise a spring operatively coupled to the upper web anchor surface 112. As such, during operation of the anchor 110 illustrated in FIGS. 7 through 9, the anchor is inserted into the cavity 12 of the decking 2, as previously discussed herein, and the one or more upper flange members 152 (e.g., two upper flange anchor surfaces 252, 254) contact the inner surface of upper flange 4 within the cavity 12 of the decking 2. Before or after the one or more upper flange members 152 contact the upper flange 4, the biasing member 190 operatively coupled to web anchor 110 may contact the upper flange 4. As illustrated in FIG. 7 the biasing member 190 may comprises at least a spring (e.g., a compression spring) that is compressed as a user continues to push the fastener operatively coupled to the web anchor 110. The web anchor 110 may then be rotated (e.g., 90 degrees) and the installer may release or allow the web anchor 110 to be moved vertically downward, by the installer and/or by the biasing member 190 (e.g., the compression spring, or other biasing member) pushing the web anchor vertically downward. The stop 186 described herein may then be used to install the anchor 100, as previously described herein.

FIG. 10 illustrates an alternate embodiment of the anchor 100 illustrated in FIG. 7, without the biasing member 190. In the embodiment illustrated in FIG. 10, the biasing of the web anchor 110 is not performed by a biasing member. Instead, an installer rotates the web anchor 110 after installing the anchor 100 into the cavity 12 of the decking 2, and the installer pulls down the web anchor 110 (e.g., without the aid of a biasing member 190) while utilizing the stop 186 in order to install the anchor 110 in the decking 2, as previously described herein.

Figure 11:
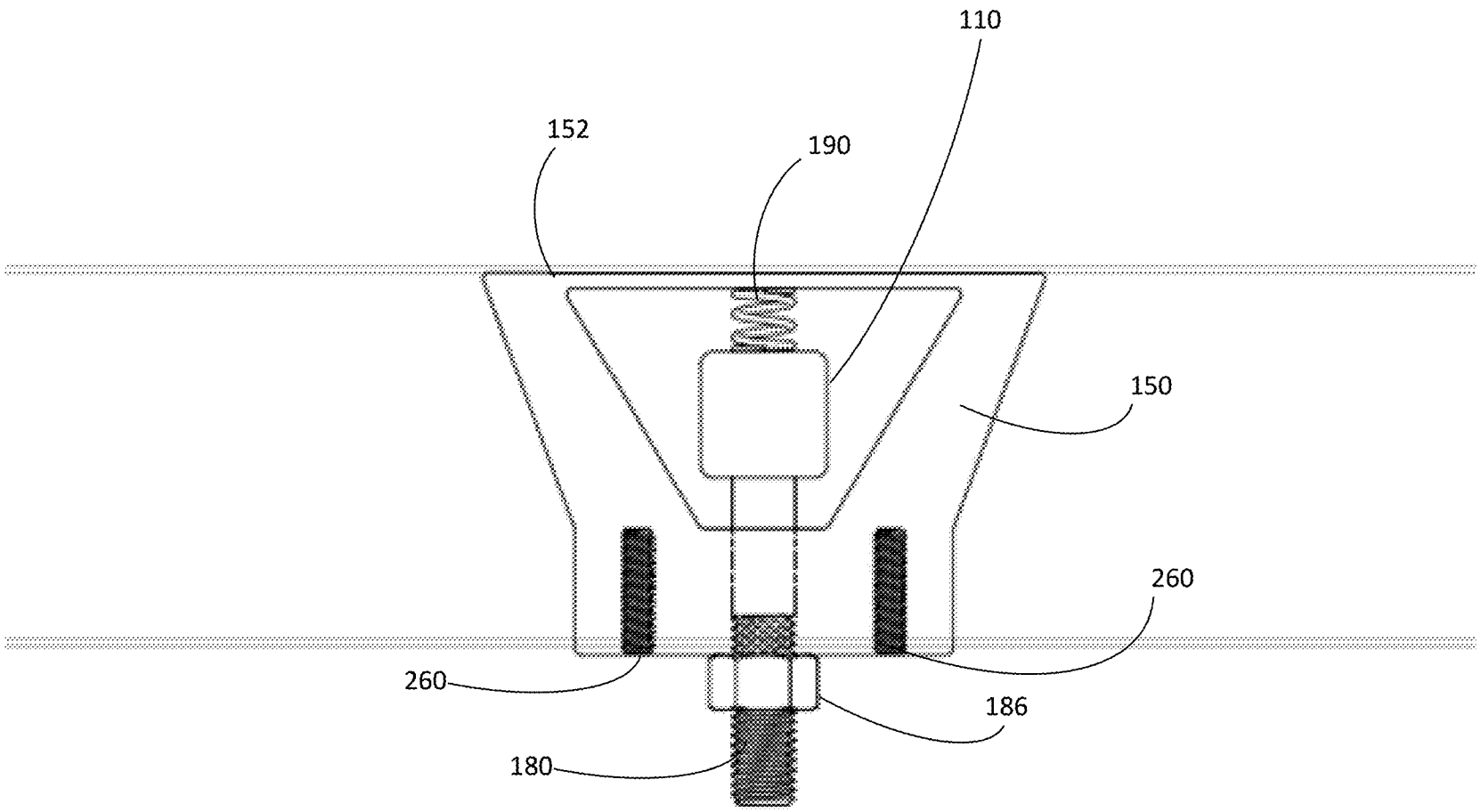
FIG. 11 illustrates a side cross-sectional view of an anchor in an installed position having multiple hanger locations, in accordance with some embodiments of the present disclosure.

FIG. 11 illustrates alternate embodiments of the anchor 100 that are similar to the anchor 100 illustrated in FIGS. 3 through 6. However, as illustrated in FIG. 11, the web anchor 110 and the fastener 180 are integral, as previously discussed with respect to FIGS. 7 through 9. Moreover, FIG. 11 illustrates that the flange base 240 comprises one or more hanger apertures 260. The one or more hanger apertures 260 may be utilized to hang components in addition to, or in lieu of the components that may be hung using the fastener 180 of the anchor system 50. The one or more hanger apertures 260 may comprise one or more threaded bore holes 262. For example, hanger fasteners (not illustrated) may be threaded into the one or more threaded bore holes 262, which may be used to hang additional components from the anchor 100.

Figure 12:
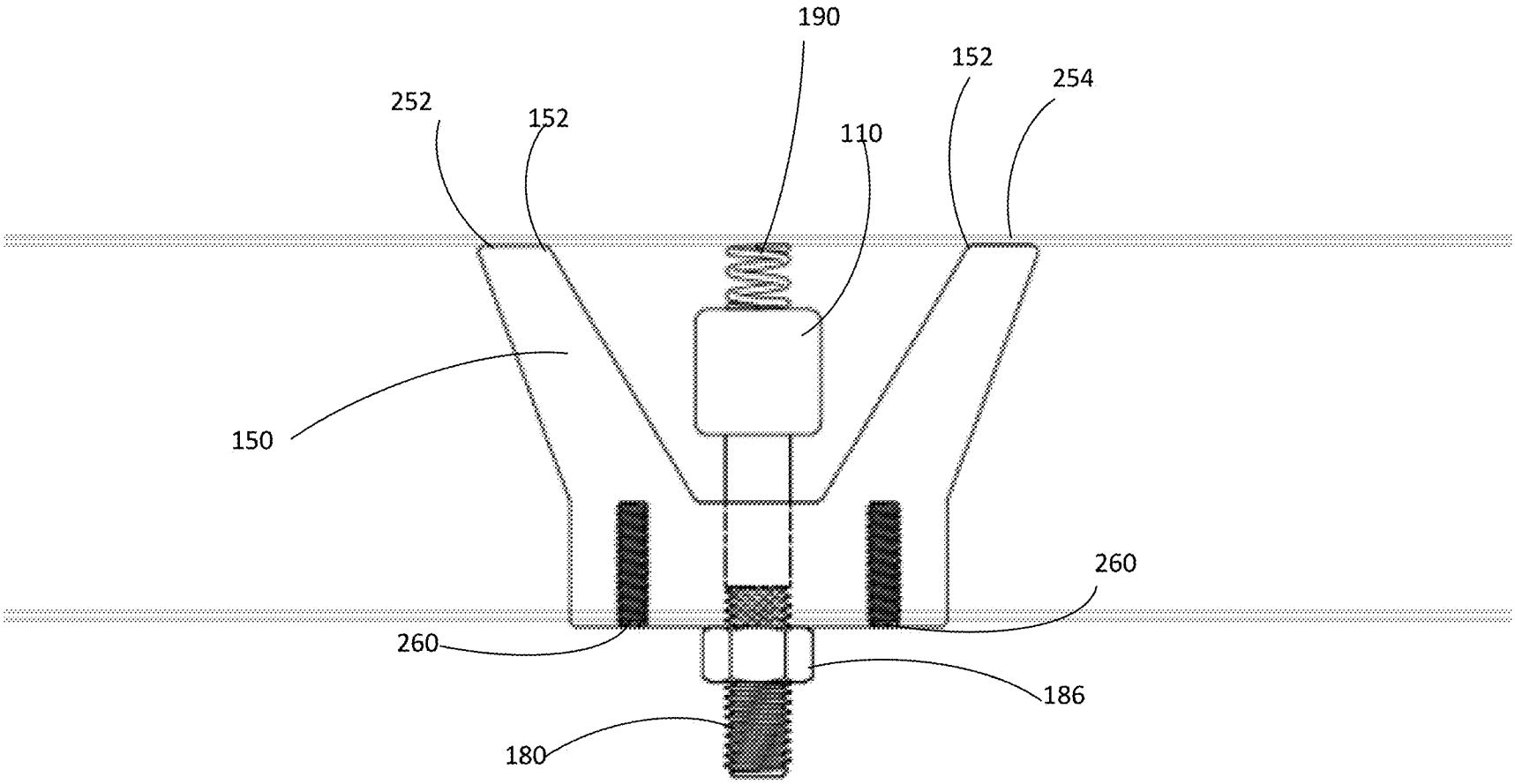
FIG. 12 illustrates a side cross-sectional view of an anchor in an installed position having multiple hanger locations, in accordance with some embodiments of the present disclosure.

FIG. 12 illustrates an embodiment of the anchor 100 that is similar to the anchor 100 illustrated in FIG. 11. However, unlike FIG. 11, FIG. 12 illustrates that the one or more upper flange surfaces 152 may comprise a first upper flange surface 252 and a second upper flange surface 254. Moreover, the biasing member 190 may be configured to contact the upper flange 4 (e.g., inner surface of the upper flange 4) directly or through another component other than the upper flange surface 152 of the flange anchor 150. FIG. 12 further illustrates the flange base 240 and one or more hanger apertures 260 as previously described with respect to FIG. 11.

Figure 13:
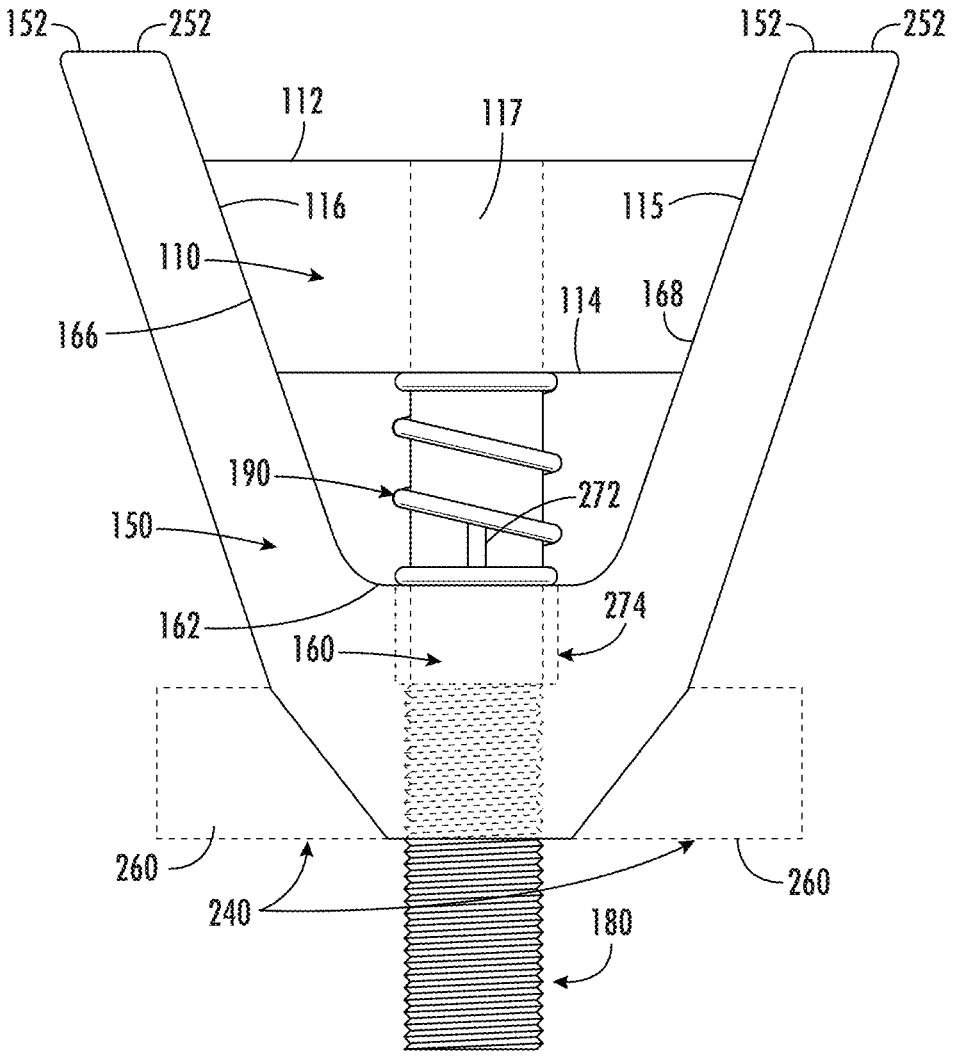
FIG. 13 illustrates a side cross-sectional view of an anchor in an assembly position having multiple hanger locations, in accordance with some embodiments of the present disclosure.

FIG. 13 illustrates an embodiment of the anchor 100 similar to the anchor 100 of FIG. 12. However, unlike FIG. 12, in some embodiments, the biasing member 190 may be located between the lower web anchor surface 114 and the lower flange aperture surface 162. For example, the biasing member 190 may be a spring operatively coupled to the lower web anchor surface 114 and the lower flange aperture surface 162. In the illustrated embodiment, unlike the other embodiments discussed herein, after the anchor 100 is installed into the cavity 12 of the decking 2, the installer may continue to push the fastener against the biasing member. In response, the web anchor 110 may extend farther into the cavity 12 (e.g., against the force of the biasing member), and the installer may rotate the web anchor 110 (e.g., 90 degrees, or the like). Thereafter, the biasing member 190 biases the web anchor 110 vertically downwardly in order to allow the opposing web anchor contacting surfaces 115, 116 to contact the internal surfaces of the webs 9 of the decking 2. For example, the biasing member 190 may comprise a spring that is in tension or placed in tension when an installer moves the web anchor 110 further into the cavity 12 of the decking 2 (while the flange anchor 150 remains stationary). After rotation of the web anchor 110, the spring in tension is biased back towards normal (e.g., not tension or compression) or less in tension.

Moreover, in some embodiments of the invention, as illustrated in FIG. 13, one or more orientation members 270 may be utilized in order to aid in the orientation of the web anchor 110 with respect to the flange anchor 150 and/or within the decking 2. In some embodiments of the invention, the one or more orientation members 270 may comprise one or more fastener locking members 272 (e.g., keys, or the like) and one or more flange locking members 274 (e.g., grooves, or the like) located within the flange fastener aperture 170, as illustrated in FIG. 13. For example, the keys and the grooves may be used to lock the orientation of the web anchor 110 with the respect to flange anchor 150 when the anchor is in the installed position.

Additionally, like FIGS. 11 and 12, FIG. 13 illustrates that the flange base 240 comprises one or more hanger apertures 260. The one or more hanger apertures 260 may be utilized to hang components in addition to, or in replacement of, the components that may be hung using the fastener 180 of the anchor system 50. As previously discussed, the one or more hanger apertures 260 may comprise one or more threaded bore holes 262 that can be operatively coupled to fasteners, which may be used to hang additional components from the anchor 100.

Figure 14:
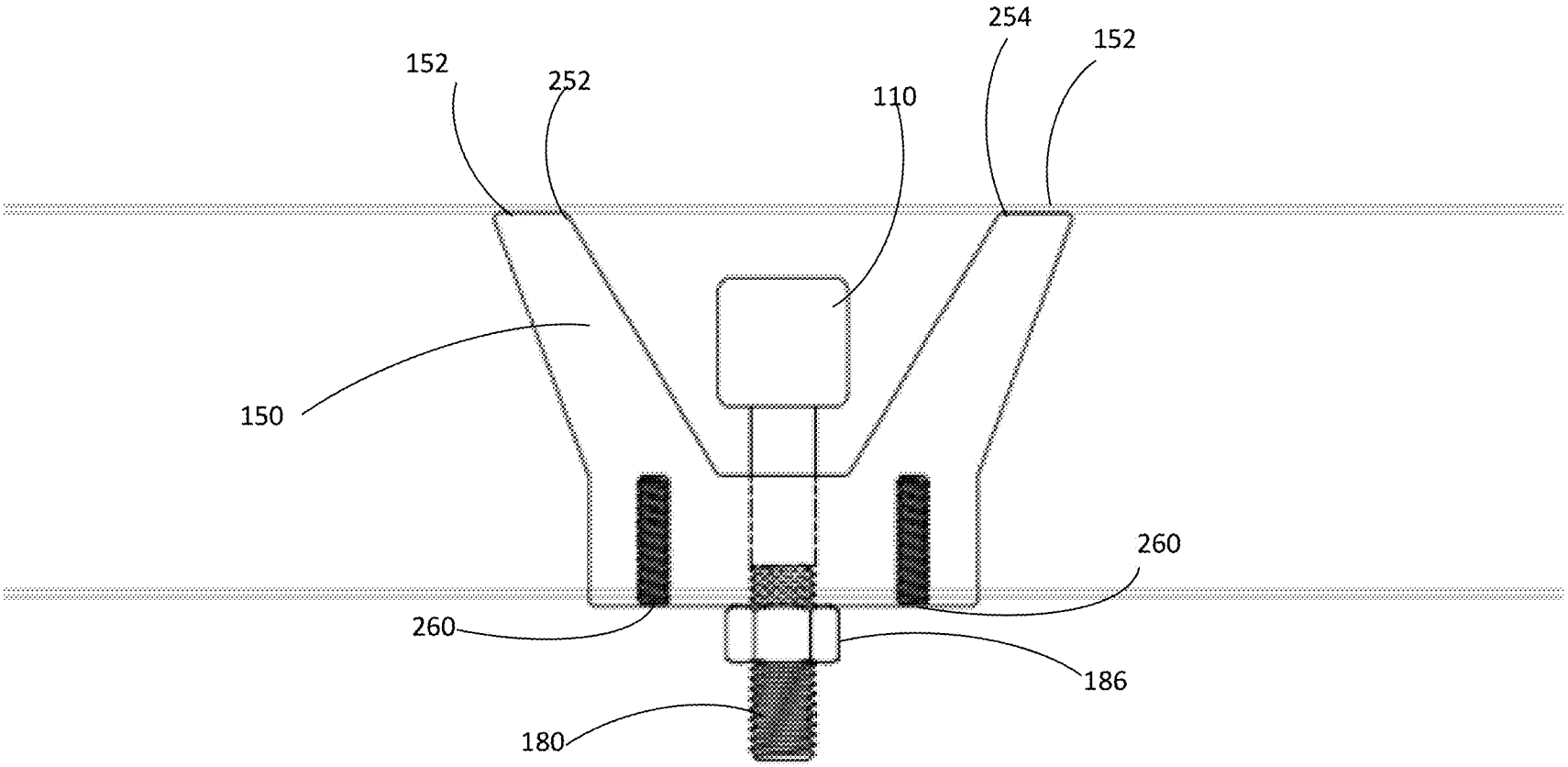
FIG. 14 illustrates a side cross-sectional view of an anchor in an installed position within the dovetail decking having multiple hanger locations, in accordance with some embodiments of the present disclosure.

FIG. 14 illustrates an embodiment of the anchor 100 that is similar to the anchors 100 illustrated in FIGS. 11, 12, and 13. However, unlike FIGS. 11 through 13, FIG. 14 illustrates the anchor system without a biasing member 190. Moreover, as illustrated and discussed with respect to FIG. 10, an installer rotates the web anchor 110 after installing the anchor 100 into the cavity 12 of the decking 2, and the installer pulls down the web anchor 110 (e.g., without the aid of the biasing member 190) while utilizing the stop 186 in order to install the anchor 110 in the decking 2.

Moreover, FIG. 15 illustrates another embodiment of the anchor 100, similar to the anchor 100 described and illustrated with respect to FIG. 11. However, as illustrated in FIG. 15, the one or more hanger apertures 260 are orientated perpendicular to the fastener 180. Moreover, FIG. 16 illustrates an anchor 100 similar to FIG. 12 except for the orientation of the one or more hanger apertures 260. Furthermore, FIG. 17 illustrates an anchor 100 similar to FIG. 14 except for the orientation of the one or more hanger apertures 260. It should be understood that the one or more hanger apertures 260 illustrated in FIGS. 15, 16, and 17 may utilize any type of fastener (e.g., screws and bolts, pins, or the like) to hang building components.

Figure 18:
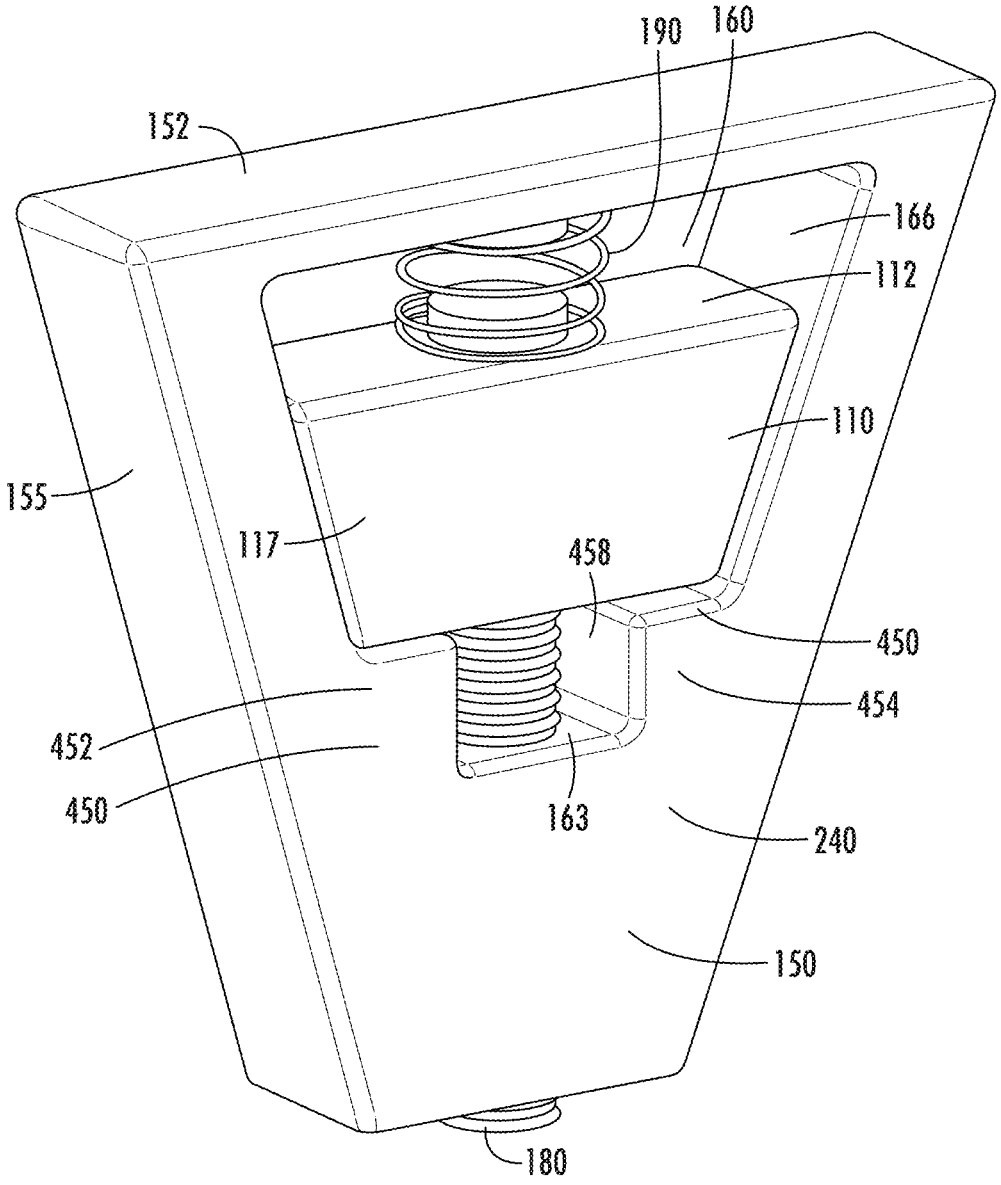
FIG. 18 illustrates a perspective view of an anchor in an assembly position, in accordance with some embodiments of the present disclosure.
Figure 19:
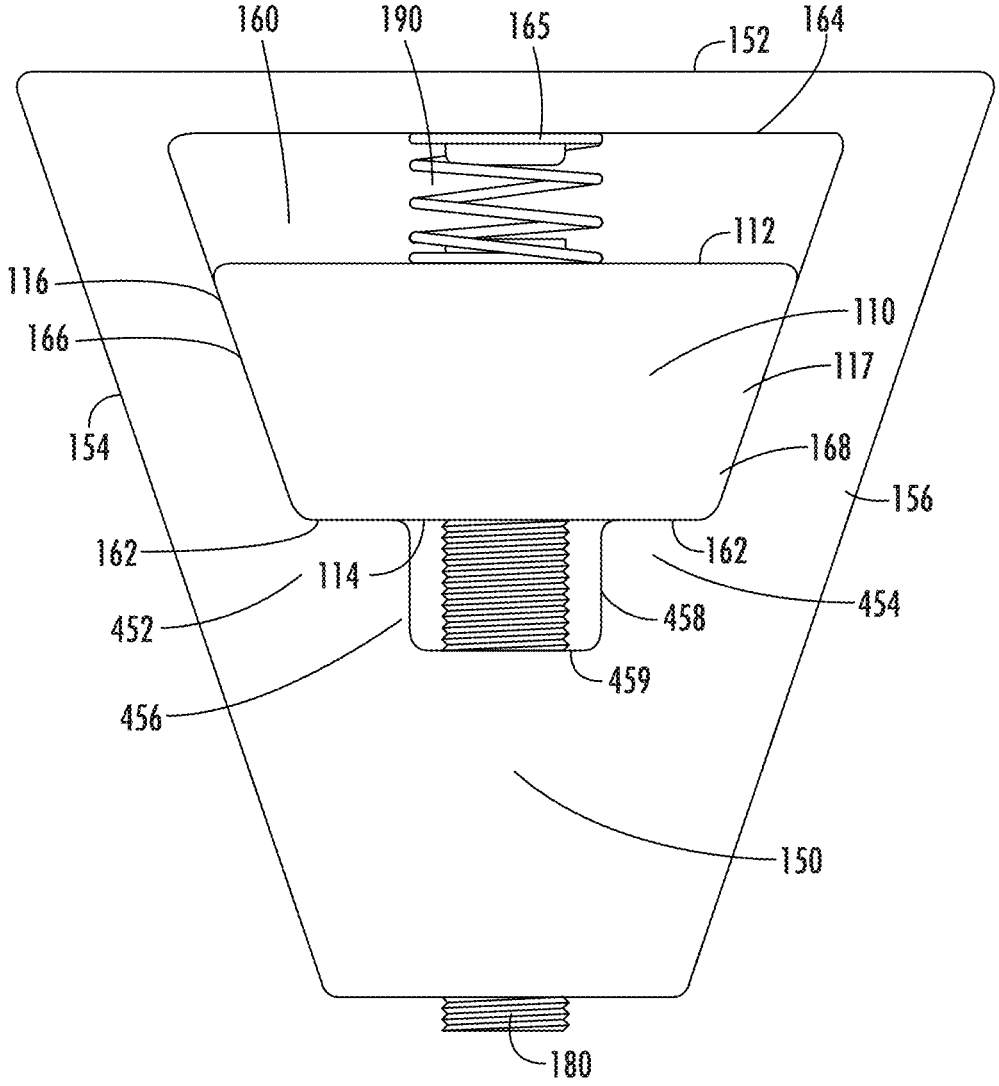
FIG. 19 illustrates a side view of an anchor in an assembly position, in accordance with some embodiments of the present disclosure.
Figure 20:
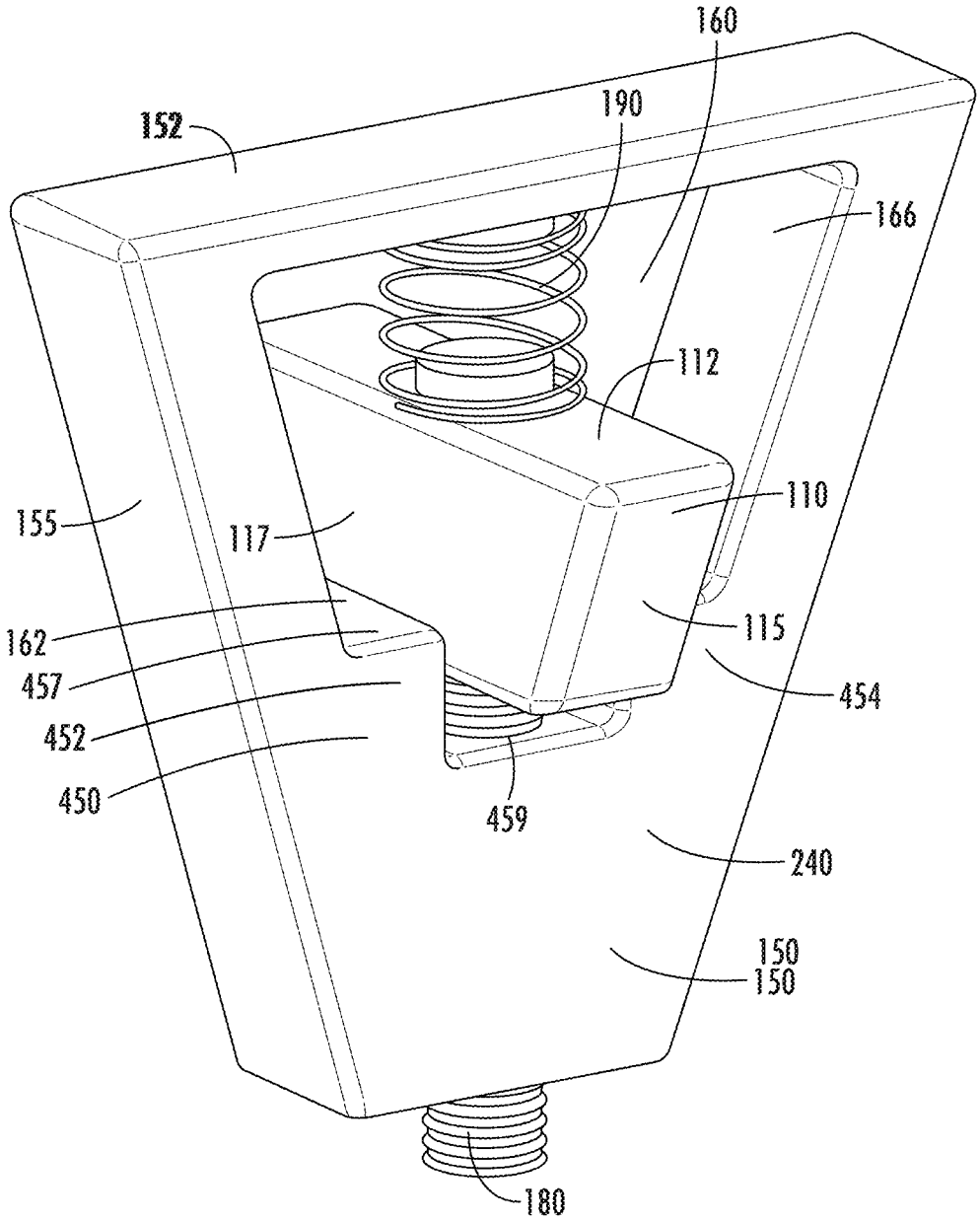
FIG. 20 illustrates a perspective view of an anchor in an installed position, in accordance with some embodiments of the present disclosure.
Figure 21:
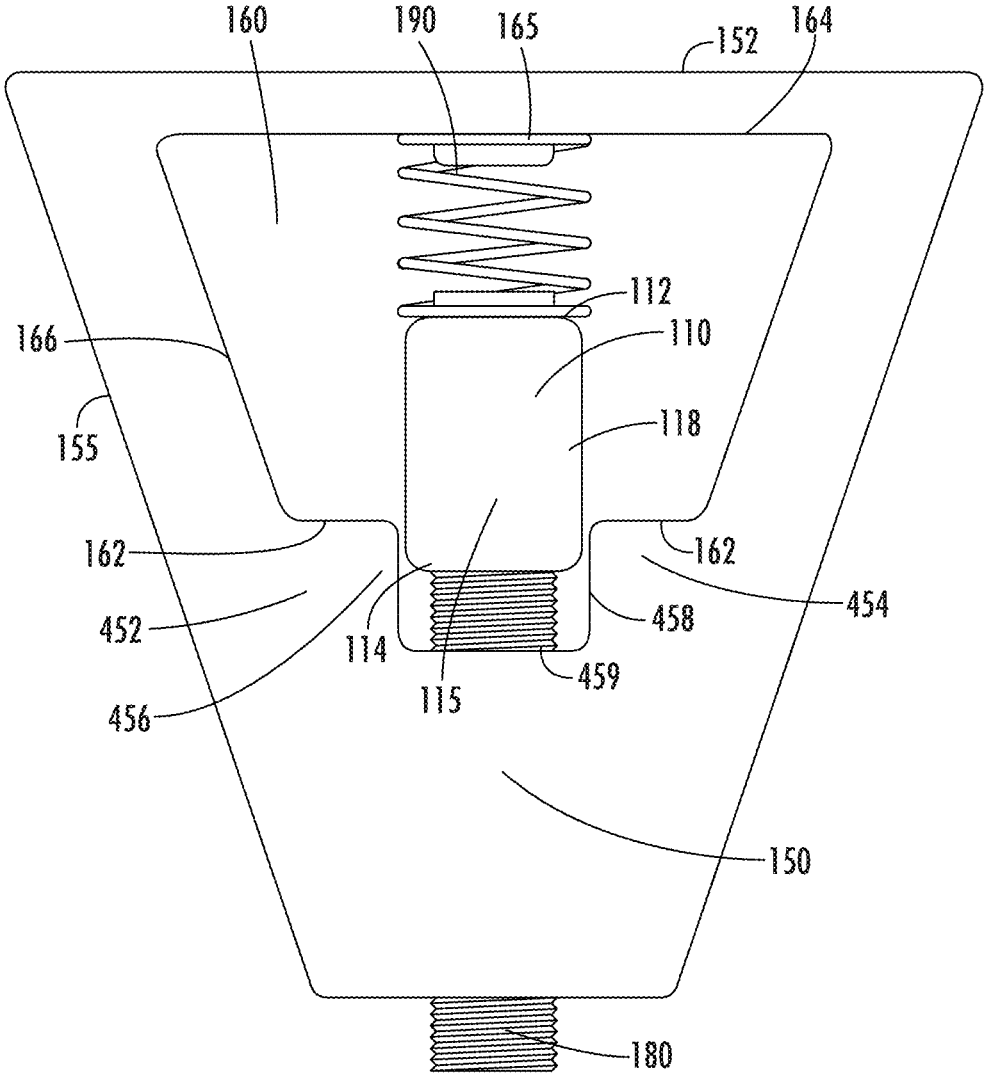
FIG. 21 illustrates a side view of an anchor in an installed position, in accordance with some embodiments of the present disclosure.
Figure 22:
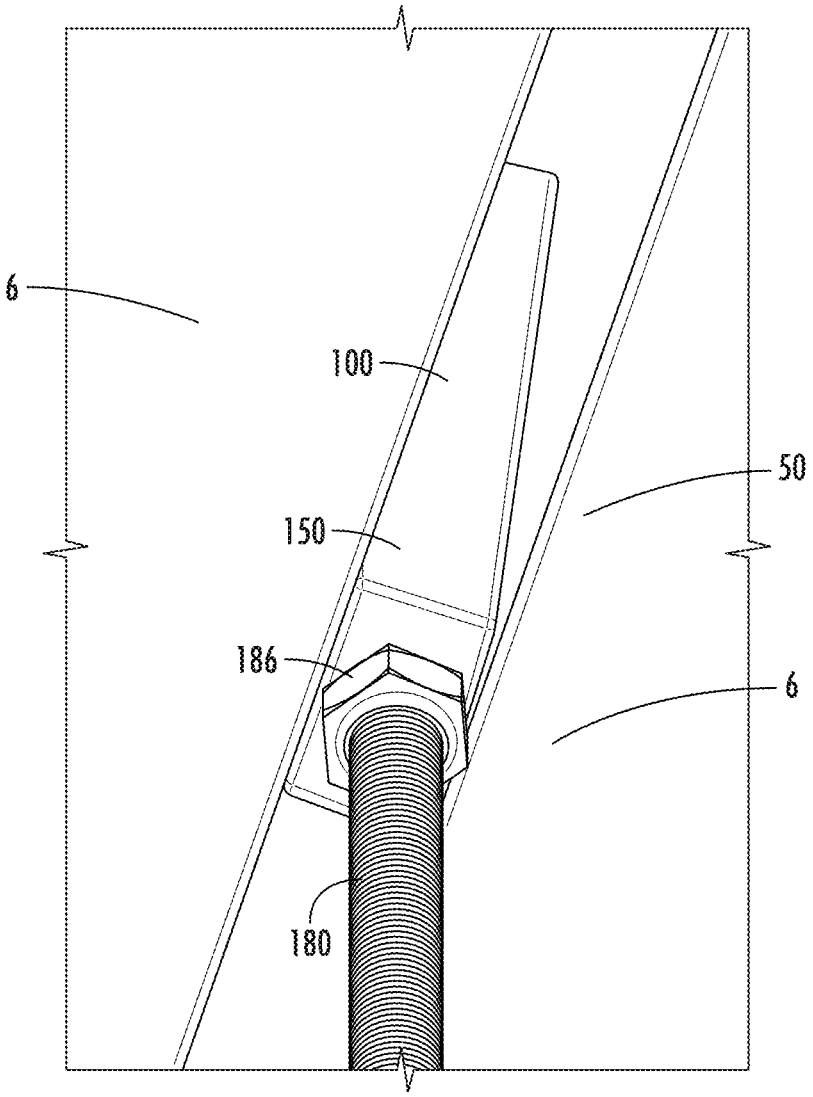
FIG. 22 illustrates a perspective view of an anchor in an installed position, in accordance with some embodiments of the present disclosure.

FIGS. 18 through 21 illustrate other embodiments of the invention similar to FIGS. 3 through 6. However, as illustrated in FIGS. 18 through 21, the flange anchor 150 comprises one or more orientation members 270 that are utilized in order to aid in the orientation of the web anchor 110 with respect to the flange anchor 150 and/or the decking 2. For example, as illustrated in FIGS. 18 through 21 the flange anchor 150 has a flange base 240 with one or more projections 450. The one or more projections 450 may comprise a first projection 452 and a second projection 454. The one or more projections 450 may form an orientation aperture 455 defined by the first projection 452 and the second projection 454. As such, the orientation aperture 455 may comprise opposing orientation surfaces (e.g., a first orientation surface 456 and a second orientation surface 458) operatively coupled to a lower orientation surface 459. As such, as illustrated in FIGS. 18 and 20, in some embodiments during assembly (e.g., in the assembly position), the lower web anchor surface 114 contacts the one or more lower flange aperture surfaces 162 formed in part from the one or more projections 450. Moreover, in the installation position, with the web anchor 110 rotated with respect to the flange anchor 150, and moved vertically downwardly into the orientation aperture, the web anchor 110 may be orientated in the desired position. As illustrated in FIGS. 20 and 21, at least a portion of the web anchor 110 may be at least partially located within the orientation aperture 455. It should be understood that in some embodiments the one or more projections 450 (e.g., the opposing orientation surfaces 456, 458) may restrict the movement of the web anchor 110, as the web anchor free surfaces 117, 118 of the web anchor 110 engage with the first orientation surface 456 and the second orientation surface 458 of the first projection 452 and the second projection 454 in the flange anchor base 240. Moreover, it should be understood that the lower web anchor surface 114 may or may not contact a lower orientation aperture surface 459. As illustrated by FIGS. 20 and 21, the one or more projections 450 may orientate the web anchor 110 within the flange anchor 150 and/or the cavity 12 of the decking 2 in order to aid in positioning the web anchor 110 and/or the flange anchor 150 in the desired orientation for operative coupling within the cavity 12 of the decking 2.

FIG. 22 illustrates a perspective view of the anchor system 50 discussed herein in the installed position. As illustrated in FIG. 22, at least a portion of the anchor 100, such as a portion of the flange base 240 of the flange anchor 150, may be located outside of the cavity 12 of the decking 2. Alternatively, the lower anchor flange surface 154, or a portion thereof, may sit at least partially within the cavity 12 and/or be flush with the lower flange 6.

Figure 24:
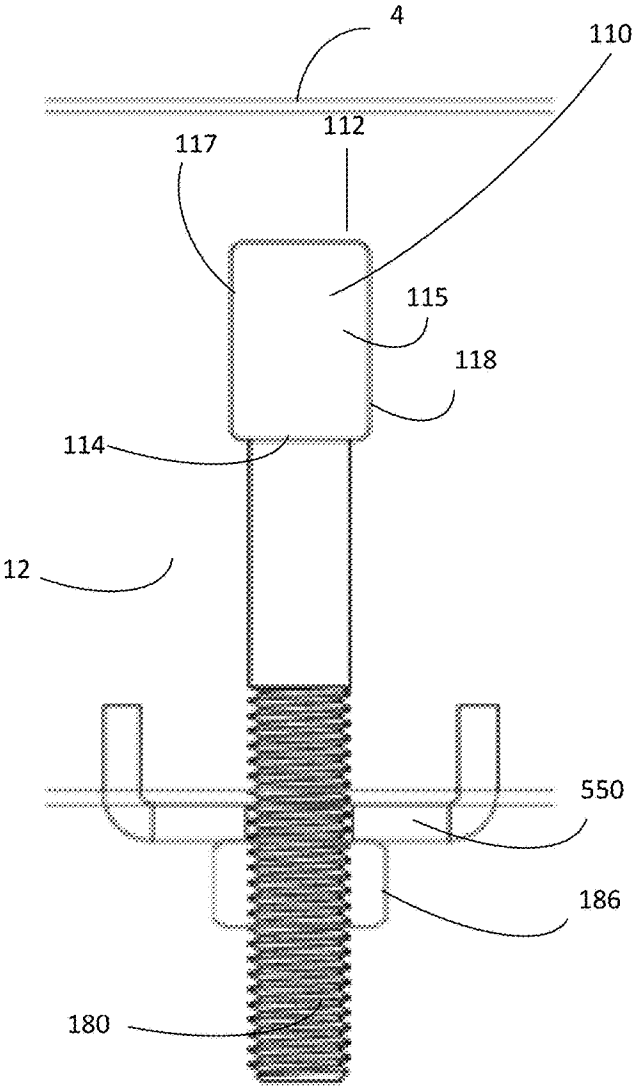
FIG. 24 illustrates a side cross-sectional view of a dovetail decking system with an anchor in an installed position, in accordance with some embodiments of the present disclosure.
Figure 23:
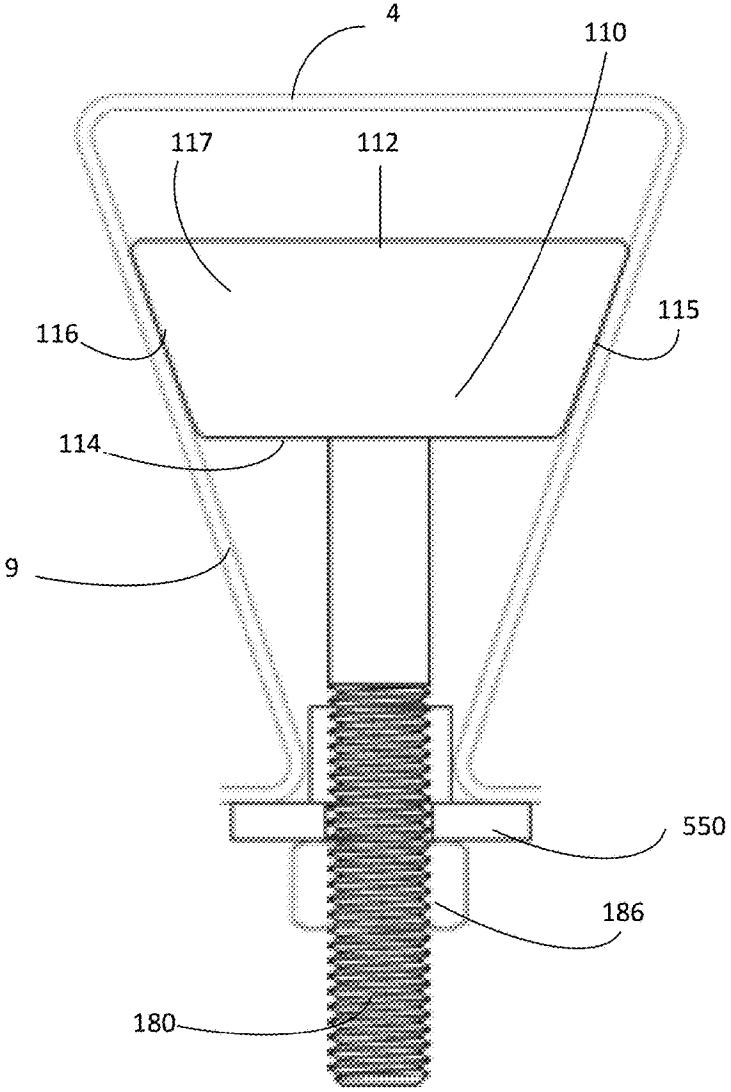
FIG. 23 illustrates an end cross-sectional view of a dovetail decking system with an anchor in an installed position, in accordance with some embodiments of the present disclosure.

FIGS. 23 through 27 illustrate alternate embodiments of the anchor system 550. As illustrated in FIGS. 23 and 24, the flange anchor 550 may be separate from the web anchor 110. The flange anchor 550 may have an upper portion 560 and a lower portion 570. The upper portion 560 may comprise one or more protrusions 562. It should be understood that the upper portion 560 of the flange anchor 550 may be inserted into the cavity 12 of the decking 2. Alternatively, the lower portion 570, may comprise a plate 572 that remains outside of the cavity 12 of the decking 2, and may further be operatively coupled with the one or more lower flanges 6 of the decking 2. As such, it should be understood, as illustrated in FIGS. 23 through 27, the upper portion 560 of the flange anchor 550, such as the one or more protrusions 562 may be utilized to aid is securing the web anchor 110 in place when installed. It should be understood that the flange anchor 550 is not utilized to orientate the web anchor 110 (which the web anchor 110 does itself based on the width of the web anchor 110), but to provide additional resistance for loading of the anchor 100. For example, the upper portion 560, such as the one or more protrusions 562, and/or the plate 572 may be used to provide loading resistance in the longitudinal direction of the flute 3 of the decking 2. That is, typically the web anchor 110 by itself does not provide loading resistance along the longitudinal direction of the flute 3 (except for some frictional resistance of the contact with the webs 9). As such, in order to provide resistance to longitudinal loading, the plate 572 acting against the lower flange 6 of the decking 2 provides loading resistance in the longitudinal direction. Moreover, plate 572 also provides resistance in other directions because of the contact with the lower flange 6 surfaces of the decking 2.

It should be further understood that after the installation of the anchor 100, such as the use of a stop 186 and fastener 180 (integral with the web anchor 110, as illustrated, or as a separate component) that operatively couples the web anchor 110 and the flange anchor 550. The contact of the web anchor contacting surfaces 115, 116 with the webs 9 and/or the upper portion 560 (e.g., the one or more protrusions 562) extending into the cavity 12 aid in preventing rotation of the anchor 100 within the cavity 12 of the decking in response to loading (e.g., torsional loading).

Hanging components, such as lights, HVAC, pipes, and/or other building components, from structural decking 2 (e.g., floor, ceiling or roof structural decking) can be a time intensive and multi-stepped process. For example, the process may require a lift or ladder to reach the structural decking 2, using a drill to drill into the structural decking panels, and in some cases, into concrete above such decking panels, and utilizing tools to install an anchor into the drilled portions of the decking 2 and/or the concrete. Alternatively, it may require both hands to secure an anchor into a flute of the decking panel 2, which may require harnesses and/or other safety protocols for installation. Moreover, if the anchor system requires repositioning in the future, the multistep process must be repeated, and in some cases the concrete and/or decking 2 is repaired. For example, when drill-in and cast in place anchors are used the installation of additional anchors and re-positioned anchors must avoid the abandoned anchor locations (e.g., the original drilled holes), as well as the shear cones of the abandoned anchor locations (e.g., cone shaped area of concrete around the location of the original anchor). The original drilled hole and shear cone location is avoided because placing a new anchor (e.g., drilled-in anchor) in a previously drilled hole and/or a shear cone of an abandoned anchor location may make the new anchor more prone to failure. That is, the cone failure, splitting failure, pull-out failure, edge failure, and/or the like may be more likely to occur should an anchor be repositioned in an abandoned anchor hole and/or cone location of an abandoned anchor.

In geographic regions that are prone to seismic activity (e.g., earthquakes) and/or high winds, the structural panels are solidly connected to each other and to the other load resisting structural members of the building so that the building is better able to withstand shear forces (e.g., horizontal shear forces and vertical shear forces) created by the seismic activity and/or high winds. The anchors 100 may also be required to provide loading resistance. The anchors 100 disclosed in the present disclosure provide improved anchoring for supporting components hung from the decking 2, and in particular, dovetail decking 2. Typically, systems that use fasteners that screw into the decking and/or concrete have limited surface to surface contact, and thus, are subject to pull-out from heavier loading applied to fasteners set within the decking and/or concrete. Moreover, other systems that only contact the webs of the decking are subject to rocking and/or movement along the longitudinal length of the channel when subjected to longitudinal loading along the length of the flutes in the decking 2. As such, it should be understood that the anchors of the present disclosure provide improved loading resistance over the systems that are traditionally used to hang components.

It should be understood that the present invention provides similar or improved shear resistance and loading in tension when compared to current available drilled in anchors of the same or similar size, such as screw-in anchors (e.g., anchors that require drilling a hole through the decking and into the concrete and then secured by the interaction of the anchor threads and concrete), epoxy anchors (e.g., anchors that require drilling a hole through the decking and into the concrete and then secured through the use of epoxy), expansion anchors (e.g., anchors that require drilling a hole through the decking and into the concrete and then secured by the interaction of the anchor expansion device and concrete), and/or other like anchors. While the shear resistance and/or loading resistance in tension of the anchors 100 of the present disclosure may be similar to drilled in anchors, the installation of the anchors 100 of the present disclosure do not require drilling into the decking and concrete, cleaning the aperture (e.g., brushing, vacuuming, blowing out the aperture, or the like), and installing the anchors into the aperture, which is much more timely and requires additional safety precautions when compared to the installation of the anchors 100 described herein. Moreover, the drilled in anchors require inspection to make sure that the apertures were property drilled and/or the anchors were properly installed, unlike the anchors 100 of the present disclosure for which installation can be verified immediately. Additionally, instead of being a permanent anchor that is destructive to the decking and/or concrete, like the drilled in anchors, the anchors 100 of the present disclosure can be moved easily and are non-destructive to the decking and/or concrete, and furthermore, do not limit where new or relocated anchors may be placed (e.g., there is no cone location that needs to be avoided). The anchors 100 of the present disclosure may be installed in some embodiments using one hand (e.g., does not require the additional safety measures that two hand installations require—such as, when installing drilled in anchors), and may be easily moved without having to repair or avoid drilled holes and/or cone locations, in the decking and/or concrete.

Alternatively, when compared with other types of non-destructive anchors, such as a wedge nut or extension anchors (e.g., horizontally extending anchors that interact with a single point on each web of the decking, or the like), the anchors 100 of the present disclosure are also easily moveable, but provide improved shear resistance (e.g., provides more shear strength in any direction compared to other non-drilled anchors). For example, the anchors 100 disclosed herein may provide tension resistance that is similar to what is provided by wedge nuts, but the anchors 100 provide more shear resistance than wedge nuts (e.g., wedge nuts that interact with the webs of the decking provide only frictional shear resistance longitudinally along the length of the flutes). As such, the shear capacity of a wedge nut longitudinally with the direction of a flute is negligible when compared to the anchors 100 disclosed herein.

With respect to the extension anchors (e.g., horizontal anchors), the anchors 100 disclosed herein provide more tension and shear resistance. The extension anchors may provide frictional resistance, and potentially some interference resistance (e.g., should the decking be pierced by the extension anchors, include embossments in which the extension anchors fit, or the like); however, the extension anchors are still subject to sliding and/or disengagement in response to shear loading. As such, unlike the extension anchors, the present invention provides shear resistance that may be 3, 4, 5, 6, 7, 8, 9, 10, 11, 12, 13, 14, 15, or the like times shear resistance of the extension anchors, or an improved shear resistance that ranges between, overlaps, or is outside of these values. That is, while the web anchor 110 provides some frictional shear resistance longitudinally along the flute (e.g., like a wedge nut), the majority of the shear resistance is provided by the flange anchor 150 that interacts with the upper and/or lower flanges of the decking.

Figure 28:
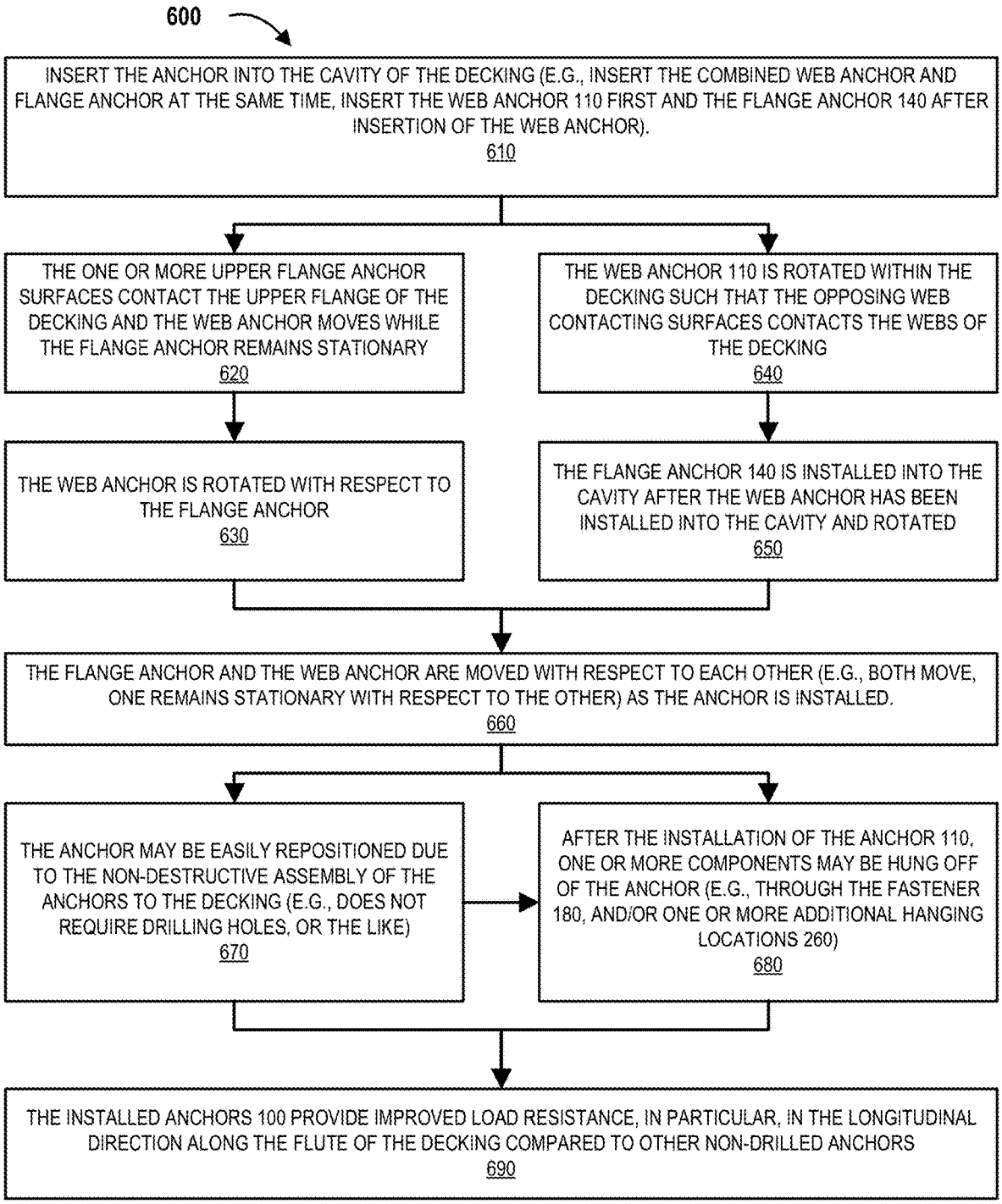
FIG. 28 illustrates processes of installing anchors, in accordance with some of the embodiments of the present disclosure.

FIG. 28 illustrates a process for installing the anchors 100 described herein. As illustrated by block 602 in FIG. 28, the anchor 100 is inserted into a cavity 12 of the decking 2. For example, the anchor 100 may be inserted into the cavity 12 (e.g., both the web anchor 110 and the flange anchor 150 at the same time) such that the opposing web anchor free surfaces 117, 118 and the third and fourth opposing flange anchor sides 157, 158 run longitudinally along with the cavity 12 of the decking 2. In some embodiments of the invention the anchor 100 is inserted into the cavity 12 until the one or more upper flange anchor surfaces 152 contact a surface of the upper flange 4 (e.g., internal surface of the upper flange 4) of a flute 3 of the decking 2. Alternatively, it should be understood that in some embodiments the web anchor 110 may be inserted into the cavity 12 of the decking 2 apart from the flange anchor 150, as will be described with respect to blocks 640 and 650.

Block 620 of FIG. 28 illustrates that the anchor 100 is installed until the one or more upper flange anchor surfaces 152 contact upper flange 4. In some embodiments, when a biasing member 190 is present, the biasing member 190 allows the web anchor 110 to move vertically with respect to the flange anchor 150. That is, the flange anchor 150 remains stationary, while the web anchor 110 continues to move towards the upper flange 4 of the decking 2, as a user pushes on the fastener 180. In this way, the one or more web anchor surfaces (e.g., the opposing web anchor free surfaces 117, 118, and in some embodiments the lower web anchor surface 114) separate from the one or more aperture surfaces (e.g., the opposing first and second flange aperture side surfaces 166, 168, and in some embodiments the lower flange aperture surface 162).

Block 630 of FIG. 28 further illustrates that once the web anchor 110 is separated from contact with the flange anchor 150 (e.g., the one or more web anchor surfaces are separated from contact with the one or more flange aperture surfaces), the web anchor 110 has the ability to rotate with respect to the to the flange anchor 150, while the flange anchor 150 remains stationary. For example, the opposing third and fourth flange anchor sides 157, 158 are restricted from rotating within in the cavity 12 by a portion of the decking 2, such as a portion of the webs 9 and/or lower flanges 6 (e.g., decking corners 14 wherein the webs 9 and/or lower flanges 6 meet), and/or by the contact between the upper flange 4 of the decking 2 and the one or more upper flange anchor surfaces 152. As such, the web anchor 110 may be rotated approximately ninety (90) degrees into a second position (e.g., an installed position), such that the plane of the opposing web anchor free surfaces 117, 118 are perpendicular with the plane of the third and fourth opposing flange anchor sides 157, 158, as illustrated in FIG. 6.

Block 640 illustrates a different installation process, in which the web anchor 110 is inserted into the cavity and rotated (e.g., 90 degrees) such that the opposing web contacting surfaces 115, 116 contact the interior surfaces of the webs 9 within the cavity 12 of the decking 2 before installation of the flange anchor 150.

As illustrated by block 650 in FIG. 28, the flange anchor 150 is then inserted into the cavity 12 of the decking 2. For example, the flange anchor 150 may be installed such that the fastener 180 is inserted through the flange fastener aperture 170, and at least a portion of the flange anchor 150 (e.g., a first flange support 142, a second flange support 144, and/or a portion of the flange base 140 from which the supports 142, 144 extend) is inserted into the cavity 12 of the decking. It should be understood that, while the anchor 100 installation described with respect to blocks 640 and 650 provide the same structural benefits of the anchor 100 installation described with respect to blocks 620 and 630, this installation process may require two hands for the installer to install the anchor. As such, this installation process described with respect to blocks 640 and 650 may require additional levels of safety (e.g., harnesses to support the installer), while the anchor described with respect to blocks 620 and 630 may not require additional levels of safety because it may be installed using one hand.

Regardless of the installation processes for the anchors 100 described in blocks 620-650, block 660 of FIG. 28 further illustrates that the web anchor 110 and the flange anchor 150 may be biased with respect to each other. For example, an installer may utilize a stop 186, such as a nut or other like feature to install the anchor system 50. For example, an installer may utilize the stop to draw the web anchor 110 lower vertically while the flange anchor 150 remains stationary. Alternatively, the stop 186 may be utilized to push the flange anchor 150 vertically upward while the web anchor 110 remains stationary. In other embodiments, the stop 186 may be used to pull the web anchor 110 in one direction, while pushing the flange anchor 150 in another direction, in order to operatively couple the anchor 110 within the decking 2, as well as to operatively couple the web anchor 110 to the flange anchor 150 such that they will not move with respect to each other.

As such, in some examples, as a nut is rotated (e.g., clockwise), the nut will move up the fastener, engage the lower flange surface 154 or a component there between (e.g., a washer 188, or the like), then through continued rotation of the nut the fastener 180 will be moved vertically downward, which draws the web anchor 110 downward and/or the flange anchor 150 will be push vertically upward. The stop 186 is used until at least a portion of (or all of) the opposing web contacting surfaces 115, 116 contact the interior surfaces of the webs 9 within the cavity 12 of the decking 2 (e.g., as illustrated in FIG. 6) and/or the one or more upper flange anchor surfaces 152 contact the interior surfaces of the upper flange 4 of the decking 2.

Consequently, the fastener 180 and the stop 186 are used to bias the web anchor 110 with respect to the flange anchor 150, the web anchor 110 against the webs 9, and the flange anchor 150 against the internal surface of the upper flange 4 of the decking 2.

It should be further understood that as previously discussed herein, in some embodiments, a biasing member 190 may be used to bias the web anchor 110 against the flange anchor 150 (e.g., against the first and second flange aperture side surfaces 166, 168) in the assembly position as illustrated in FIG. 5, and/or against the webs 9 of the decking 2 in the installed position as illustrated in FIG. 6 while the stop 186 is installed.

Block 670 illustrates that after installation of the one or more anchors 100, the one more anchors 100 may be repositioned easily, due at least in part to the non-destructive nature of the anchors 100. That is, the installation process does not require drilling, deforming, or the like of the decking 2 and/or the anchors 100 themselves. Furthermore, new anchors 100 and/or repositioning originally installed anchors 100 does not require having to avoid previously drilled holes and/or shear cones of abandoned anchors (e.g., drilled anchors). As such, in order to move the anchors 100 of the present disclosure, the stop 186 may be at least partially disengaged (e.g., loosened, removed, or the like) and the anchor 100 may be slid along the decking 2 within the cavity and/or easily removed and replaced at a different location within the cavity 12 of the decking 2.

Block 680 of FIG. 28 illustrates that after final positioning of the anchor 100, components may be hung from the fastener 180 and/or from the one or more hanging locations 260 described herein. That is, as described herein, piping, HVHC, lighting, products (e.g., products within a store, or the like), structural building components (e.g., racking systems, lateral bracing, or the like), and/or the like may be installed.

Finally, as illustrated by block 690 of FIG. 28, and as previously described herein, the installed anchor 100 provides improved load resistance over traditional drilled in anchors, in particular, improved load resistance in the longitudinal direction along the flute 3 of the decking 2.

Figure 29:
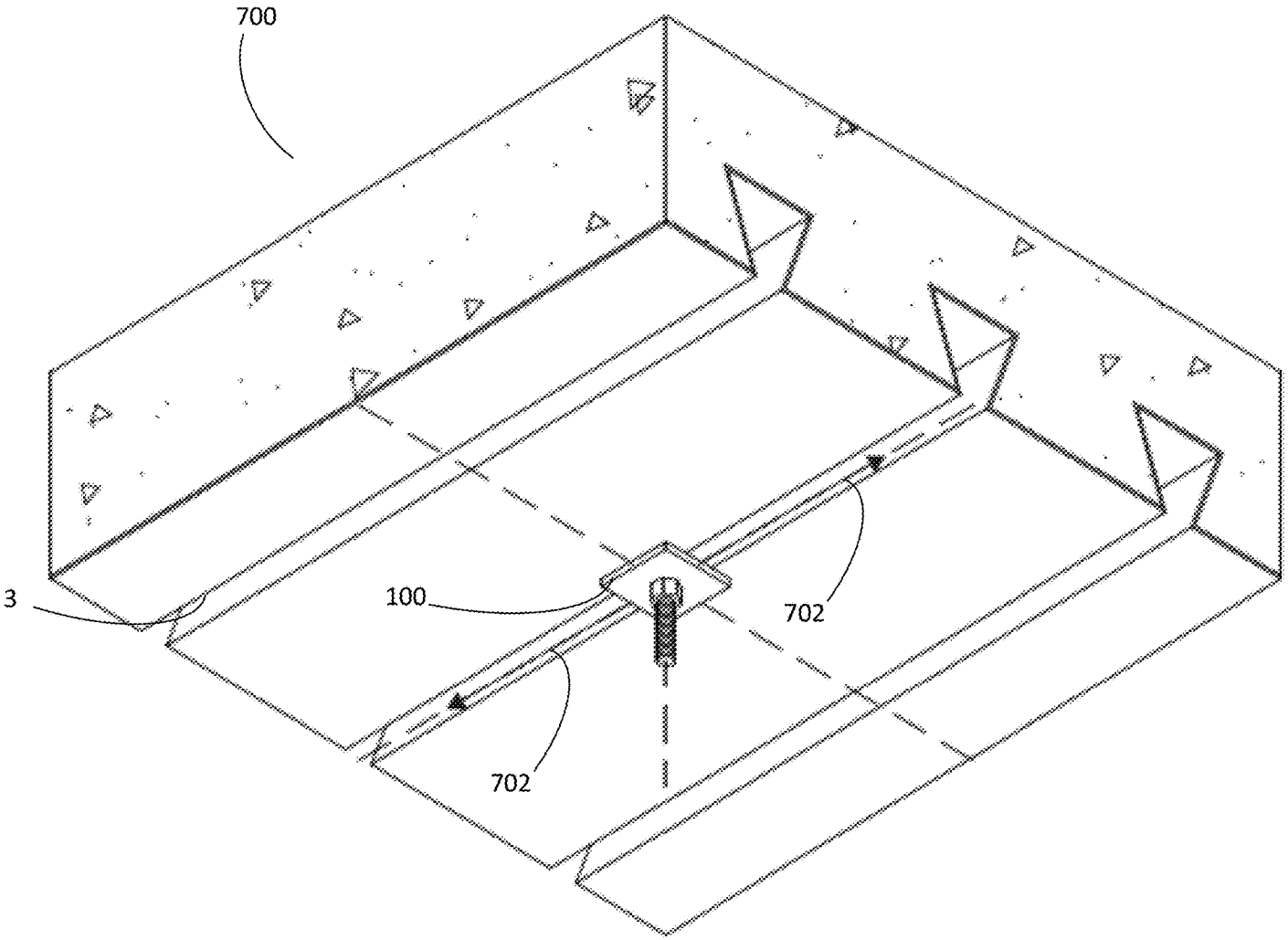
FIG. 29 illustrates a shear testing diagram for testing the shear strength of the anchor, in accordance with some of the embodiments of the disclosure.

FIG. 29 illustrates a testing set-up 700 for testing the shear strength of the installed anchor 100. For example, one monotonic and three cyclic load tests were performed on the decking anchor 100. The testing performed may be based on the CUREE testing protocol. As illustrated in FIG. 29, the decking anchor 100 was loaded in the direction parallel to the flutes 3 running along the decking 2, that is, loaded in the direction of the arrows 702 illustrated in FIG. 29 (e.g., in one direction for the monotonic loading and both directions for the cyclical loading).

Figure 30:
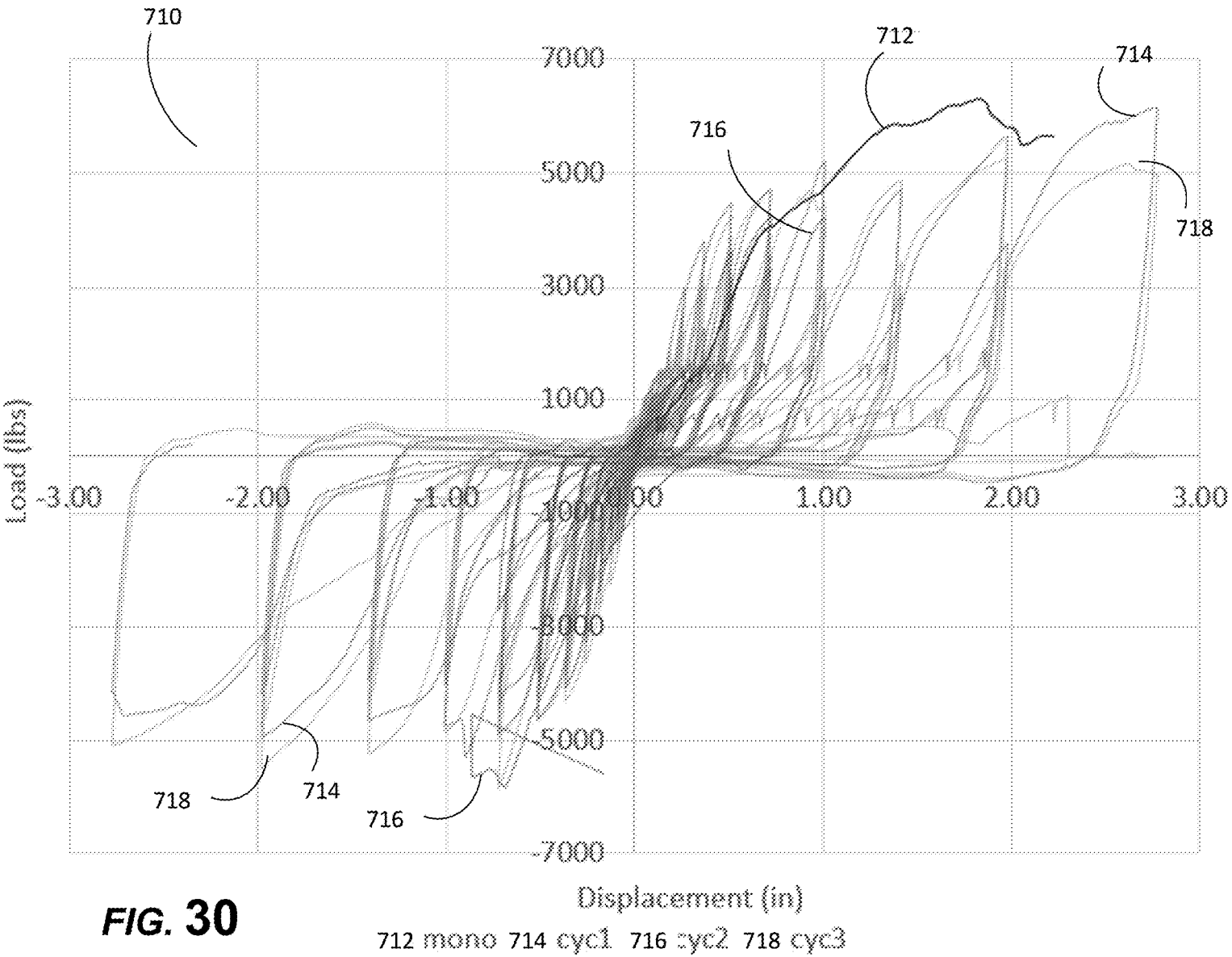
FIG. 30 illustrates a graph showing the results of shear testing of the anchor, in accordance with some of the embodiments of the present disclosure.

FIG. 30 illustrates the results of the monotonic loading and cyclic loading tests in a graph 710. As illustrated, by the line 712 the monotonic loading resulted in a nominal strength around approximately 6,000 lbs. Additionally, the cyclic loading illustrated a nominal shear strength around approximately 6,000 lbs. Specifically, the average nominal shear strength of the anchor based on the cyclic lateral loading is approximately 5,900 lbs., as illustrated by the average of the nominal values of the average of lines 714, 716, 718. Alternatively, other types of anchors, such as, but not limited to screw in anchors (e.g., requires drilling and screwing the anchors into the decking and concreate), wedge anchors (e.g., requires drilling and expansion of the anchor in the drilled hole), cast-in-place anchors (e.g., installed above the deck before concrete is poured, may punch through the decking, be threaded, and/or the like), or other like anchors have lower nominal strengths. For example, Table 1 below illustrates a comparison of the approximate nominal shear strength of the decking anchor of the present disclosure compared to the nominal strength of traditional types of anchors having a similar size and application.

TABLE 1

Comparison of Nominal Strengths of Different Anchors

| | Decking Anchor | Screw Anchor | Wedge Anchor | Cast Anchor |
|---|---|---|---|---|
| Nominal Strength (lbs.) | ~5900 | ~4400 | ~3200 | ~3100 |

Table 2 provided below illustrates a comparison of the percent improved nominal shear strength of the decking anchor of the present disclosure with respect to traditional types of anchors having a similar size and application.

TABLE 2

Percent Improvement of Nominal Strength of the Anchor vs. Traditional Anchors

| | Screw Anchor | Wedge Anchor | Banger Anchor |
|---|---|---|---|
| Percent Improvement of the Decking Anchor Nominal Strength Over Typical Anchors | 34% Nominal Strength Improvement | 84% Nominal Strength Improvement | 90% Nominal Strength Improvement |

Consequently, the decking anchor 100 of the present invention provides improved strength, such as a nominal strength, that is 5, 10, 15, 20, 25, 30, 35, 40, 45, 50, 60, 70, 80, 90, 100, 120, 140, 160, 180, 200, 300, or the like percentage greater than the nominal strength of various traditional anchors. It should be understood that the percent improvement of the nominal strength of the present invention may be between, overlap, or be outside of any of the values described herein. Moreover, the percent improvement of the nominal strength of the present invention may be +/−1, 2, 3, 4, 5, 6, 8, 10, 12, 15, 20, 25, 30, 35, 40, or the like percent of any of the values described or illustrated herein.

It should be understood that "operatively coupled," when used herein, means that the components may be formed integrally with each other, or may be formed separately and coupled together. Furthermore, "operatively coupled" means that the components may be formed directly to each other, or to each other with one or more components located between the components that are operatively coupled together. Furthermore, "operatively coupled" may mean that the components are detachable from each other, or that they are permanently coupled together.

Certain terminology is used herein for convenience only and is not to be taken as a limitation on the embodiments described. For example, words such as "top", "bottom", "upper," "lower," "left," "right," "horizontal," "vertical," "upward," and "downward" merely describe the configuration shown in the figures. Indeed, the referenced components may be oriented in any direction and the terminology, therefore, should be understood as encompassing such variations unless specified otherwise. Throughout this disclosure, where a process or method is shown or described, the method may be performed in any order or simultaneously, unless it is clear from the context that the method depends on certain actions being performed first.

Also, it will be understood that, where possible, any of the advantages, features, functions, devices, and/or operational aspects of any of the embodiments of the present invention described and/or contemplated herein may be included in any of the other embodiments of the present invention described and/or contemplated herein, and/or vice versa. In addition, where possible, any terms expressed in the singular form herein are meant to also include the plural form and/or vice versa, unless explicitly stated otherwise. Accordingly, the terms "a" and/or "an" shall mean "one or more."

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations, modifications, and combinations of the just described embodiments can be configured without departing from the scope and spirit of the invention. Therefore, it is to be understood that, within the scope of the appended claims, the invention may be practiced other than as specifically described herein.

What is claimed is:

1. A decking system comprising:

dovetail decking having a plurality of flutes, wherein the plurality of flutes comprise an upper flange, a portion of a first lower flange and a portion of second lower flange, and webs operatively coupling the upper flange to the first lower flange and the second lower flange; and one or more decking anchors, wherein each of the one or more decking anchors comprise:

a first anchor portion;

a second anchor portion operatively coupled to the first anchor portion, wherein the second anchor portion comprises one or more upper flange anchor surfaces, and wherein the first anchor portion and the second anchor portion move with respect to each other;

a fastener operatively coupled to the first anchor portion or the second anchor portion; and a stop operatively coupled to the fastener, wherein the stop impedes movement of the first anchor portion with respect to the second anchor portion when the stop is in an engaged position;

wherein in an installed position the first anchor portion contacts the webs of a flute in the dovetail decking; and wherein in the installed position the one or more upper flange anchor surfaces of the second anchor portion contact the upper flange of the flute of the dovetail decking.

2. The decking system of claim 1, wherein the first anchor portion is a web anchor and the second anchor portion is a flange anchor.

3. The decking system of claim 2, wherein the web anchor comprises opposing contact surfaces and opposing free surfaces, and wherein the opposing contact surfaces meet the webs of the dovetail decking in the installed position.

4. The decking system of claim 2, further comprising a biasing member operatively coupled to the web anchor or the flange anchor, wherein the biasing member aids in biasing the web anchor with respect to the flange anchor in an assembly position during assembly or within the flute in the installed position.

5. The decking system of claim 2, wherein the flange anchor comprises:

a base;

a first support having a first upper flange anchor surface of the one or more upper flange anchor surfaces; and a second support having a second upper flange anchor surface of the one or more upper flange anchor surfaces;

wherein the first support and the second support are operatively coupled to the base and form a flange anchor aperture, and wherein the first support or the second support contact the upper flange of the flute of the dovetail decking.

6. The decking system of claim 2, wherein in an assembly position the first anchor portion and the second anchor portion pass through an opening in the flute of the dovetail decking.

7. The decking system of claim 2, wherein the web anchor rotates with respect to the flange anchor.

8. A method of installing a decking anchor in dovetail decking, the method comprising:

installing the decking anchor into a cavity of a flute within the dovetail decking;

wherein the dovetail decking comprises a plurality of flutes, wherein the plurality of flutes comprise an upper flange, a portion of a first lower flange and a portion of second lower flange, and webs operatively coupling the upper flange to the first lower flange and the second lower flange; and wherein the decking anchor comprises:

a first anchor portion;

a second anchor portion operatively coupled to the first anchor portion, wherein the second anchor portion comprises one or more upper flange anchor surfaces, and wherein the first anchor portion and the second anchor portion move with respect to each other;

a fastener operatively coupled to the first anchor portion or the second anchor portion; and a stop operatively coupled to the fastener, wherein the stop impedes movement of the first anchor portion with respect to the second anchor portion when the stop is in an engaged position;

wherein in an installed position the first anchor portion contacts the webs of the flute in the dovetail decking; and wherein in the installed position the one or more upper flange anchor surfaces of the second anchor portion contact the upper flange of the flute of the dovetail decking.

* * * * *